US007663589B2

(12) United States Patent
Ha et al.

(10) Patent No.: US 7,663,589 B2
(45) Date of Patent: Feb. 16, 2010

(54) ELECTRO-LUMINESCENCE DISPLAY DEVICE AND DRIVING METHOD THEREOF

(75) Inventors: Won Kyu Ha, Gyeongsangbuk-do (KR); Hak Su Kim, Seoul (KR); Jae Do Lee, Gyeongsangbuk-do (KR); Ki Heon Kim, Gyeongsangbuk-do (KR); Jung Min Seo, Daegu (KR); Hyun Joung Kim, Daegu (KR)

(73) Assignee: LG Electronics Inc., Seoul (KR)

( * ) Notice: Subject to any disclaimer, the term of this patent is extended or adjusted under 35 U.S.C. 154(b) by 722 days.

(21) Appl. No.: 11/046,803

(22) Filed: Feb. 1, 2005

(65) Prior Publication Data

US 2005/0168417 A1 Aug. 4, 2005

(30) Foreign Application Priority Data

Feb. 3, 2004 (KR) ..... 10-2004-0006879
Feb. 3, 2004 (KR) ..... 10-2004-0006880

(51) Int. Cl.
*G09G 3/36* (2006.01)

(52) U.S. Cl. ..... 345/92; 345/82; 345/55; 345/36

(58) Field of Classification Search ..... 345/92, 345/82, 55, 36
See application file for complete search history.

(56) References Cited

U.S. PATENT DOCUMENTS 5,990,629 A * 11/1999 Yamada et al. ..... 315/169.3

FOREIGN PATENT DOCUMENTS

CN 1216135 A 5/1999
KR 10-2003-0004048 A 1/2003

* cited by examiner

*Primary Examiner*—Richard Hjerpe
*Assistant Examiner*—Leonid Shapiro
(74) *Attorney, Agent, or Firm*—Birch, Stewart, Kolasch & Birch, LLP

(57) ABSTRACT

There is disclosed an electro-luminescence display device that is adaptive for preventing picture quality deterioration by operating a thin film transistor for an electro-luminescence cell drive at a non-saturation area to compensate a threshold voltage, and a driving method thereof.

An electro-luminescence display device according to an embodiment of the present invention includes an electro-luminescence cell connected between a first supply voltage source and a ground voltage source to emit light by a current supplied from the first supply voltage source; a cell driver formed every intersection of gate lines and data lines and connected between the first supply voltage source and the electro-luminescence cell to control a current flowing in the pixel cell; and a pulse supplier supplies to the electro-luminescence cell a pulse amplitude modulation signal which is divided to have N (N is a natural number) numbers of different voltage levels from each other, and wherein the driving thin film transistor operates at the non-saturation region.

41 Claims, 13 Drawing Sheets

ELECTRO-LUMINESCENCE DISPLAY DEVICE AND DRIVING METHOD THEREOF

This application claims the benefit of Korean Patent Application Nos. P2004-06879 and P2004-06880 filed on Feb. 3, 2004, which are hereby incorporated by reference.

BACKGROUND OF THE INVENTION

1. Field of the Invention

The present invention relates to an electro-luminescence display device, and more particularly to an electro-luminescence display device that is adaptive for preventing picture quality deterioration by operating a thin film transistor for an electro-luminescence cell drive at a non-saturation area to compensate a threshold voltage, and a driving method thereof.

2. Description of the Related Art

Recently, there have been highlighted various flat panel display devices reduced in weight and bulk that is capable of eliminating disadvantages of a cathode ray tube (CRT). Such flat panel display devices include a liquid crystal display (LCD), a field emission display (FED), a plasma display panel (PDP) and an electro-luminescence (EL) display, etc.

The EL display in such display devices is a self-luminous device capable of light-emitting a phosphorous material by a re-combination of electrons with holes. The EL display device is generally classified into an inorganic EL device using the phosphorous material as an inorganic compound and an organic using it as an organic compound. Such an EL display device has many advantages of a low voltage driving, a self-luminescence, a thin-thickness, a wide viewing angle, a fast response speed and a high contrast, etc, such that it can be highlighted into a post-generation display device.

The organic EL device is usually comprised of an electron injection layer, an electron carrier layer, a light-emitting layer, a hole carrier layer and a hole injection layer that are disposed between a cathode and an anode. In such an organic EL device, when a pre-determined voltage is applied between an anode and a cathode, electrons produced from the cathode are moved, via the electron injection layer and the electron carrier layer, into the light-emitting layer while holes produced from the anode are moved, via the hole injection layer and the hole carrier layer, into the light-emitting layer. Thus, the electrons and the holes fed from the electron carrier layer and the hole carrier layer emit a light by their re-combination at the light-emitting layer.

An active matrix EL display device using such an organic EL device, as shown in FIG. 1, includes an EL panel 20 having pixel cells 28 inclusive of EL cells OLED arranged at areas defined by intersections between gate lines GL and data lines DL, a gate driver 22 to drive the gate lines GL of the EL panel 20, a data driver 24 to drive the data lines DL of the EL panel 20, and a gamma voltage generator 26 that supplies a plurality of gamma voltages VH to VL to the data driver 24.

The gate driver 22 supplies a scan pulse to the gate lines GL to sequentially drive the gate lines GL.

The gamma voltage generator 26 generates different gray level gamma voltages VH to VL between a gamma voltage VL of high gray level and a gamma voltage VH of low gray level by use of n numbers of resistors connected in series between a ground voltage source and a supply voltage source (not shown), to supply the generated voltage to the data driver 24.

The data driver 24 converts a digital data signal inputted from the outside into an analog data signal by use of the gamma voltage VH to VL from the gamma voltage generator 26. And the data driver 24 supplies the analog data signal to the data lines DL whenever the scan pulse is supplied.

Each of the pixels 28 receives a data signal from the data line DL when a scan pulse is applied to the gate line GL to generate a light corresponding to the data signal.

For this, each of the pixels 28, as shown in FIG. 2, includes an EL cell OLED connected between the supply voltage source VDD and the ground voltage source GND, and a cell driver 30 to drive the EL cell OLED.

The cell driver 30 includes a switching thin film transistor T1, of which a gate terminal is connected to the gate line GL, a source terminal is connected to the data line and a drain terminal is connected to a first node N1; a driving thin film transistor T2 of which a gate terminal is connected to the first node N1, a drain terminal is connected to the supply voltage source VDD and a source terminal is connected to an anode of the EL cell OLED; and a storage capacitor Cst connected between the supply voltage source VDD and the first node N1.

The switching thin film transistor T1 is turned on when a scan pulse is supplied to the gate line GL, thereby supplying the data signal of the data line DL to the first node N1. The data signal supplied to the first node N1 is charged in the storage capacitor Cst and supplied to the gate terminal of the driving thin film transistor T2. The driving thin film transistor T2 responds to the data signal supplied to the gate terminal to control the amount of current Id supplied from the supply voltage source VD through the EL cell OLED. And, even the switching thin film transistor T1 is turned off, the driving thin film transistor T2 remains at an on-state by the data signal charged at the storage capacitor Cst, thus it can control the current amount Id supplied from the supply voltage source VDD through the EL cell OLED till a data signal of next frame is supplied.

On the other hand, each of the switching thin film transistor T1 and the driving thin film transistor T2 of the cell driver 30 uses an amorphous silicon layer as a semiconductor layer. At this moment, the amorphous silicon layer has a disadvantage of it mobility is low. Accordingly, a study for a poly silicon thin film transistor has recently been studied for using a poly silicon layer of excellent mobility as a semiconductor layer. The poly silicon thin film transistor can be integrated together with the driving drive integrated circuit in a substrate, thus there is an advantage that the degree of integration and price competitiveness is good. However, the strain temperature of glass is as low as 600° C., thus a crystal growth technique using high temperature of above 600° C. cannot be used in forming the poly silicon layer. Because of this, in forming the poly silicon layer, Excimer Laser Annealing (ELA) is generally used that an amorphous silicon layer is formed at a low temperature of 100~300, then the amorphous silicon layer is heat-melted with a pulse illumination by an excimer laser of wavelength 308 nm, and then the melt silicon layer is crystallized in a cooling process. The poly silicon layer can be formed without giving any thermal damage to the glass substrate by use of the ELA.

However, the excimer laser has a characteristic that its optical power is unstable and the strength of output is changed within the range of ±10%. Because of this, in the ELA, there is a problem that the size of crystal grain in the poly silicon layer is irregular, and its re-productivity is bad. Also, the excimer laser has low repetition frequency of 300Hz in pulse driving, thus there are problems that it is difficult to continuously form a crystal grain boundary, high carrier mobility might not be obtained, and a large area cannot be annealed at a high speed.

The size, the size uniformity, the number and location, and the direction of the crystal grain of the semiconductor layer formed in the ELA process have critical influence directly or indirectly on the characteristic of thin film transistor, e.g., threshold voltage Vth, sub-threshold slope, charge carrier mobility, leakage current, device stability. Accordingly, the characteristic of the thin film transistor formed on the EL panel 20 by the ELA process becomes different by lines which correspond to the illumination direction of the excimer laser because the optical power of the excimer laser is unstable and its output strength is changed within the range of ±10%.

On the other hand, the operating point Q of the driving thin film transistor T2 generally exists in a saturation region as in the characteristic graph of a transistor in FIG. 3. This is because a stable current Id can be supplied to the EL cell OLED even though the voltage Vds between the drain terminal and the source terminal of the driving thin film transistor T2 is changed. At this moment, the amount of change of the current Id flowing in the driving thin film transistor T2 in the saturation region is bigger than in the non-saturation region, for the deviation of the threshold voltage Vth of each of the driving thin film transistors T2. Accordingly, for the voltage Vgs between the same gate terminal and the source terminal of each of the driving thin film transistors T2, if the deviation of the threshold voltage Vth, as described above, is big, the change of the current Id flowing in the driving thin film transistor T2 becomes big.

Accordingly, the EL display device of the prior art expresses the gray level by the change of the data voltage, thus in case that the threshold voltage Vth of the driving thin film transistor is not uniform for each line of the EL panel 20, the amount of the current flowing in the EL cell OLED cannot be accurately controlled (in fact, the current amount decreases) for the same data voltage, thus there is a problem that a desired picture is not displayed because the brightness is not uniform.

SUMMARY OF THE INVENTION

Accordingly, it is an object of the present invention to provide an electro-luminescence display device that is adaptive for preventing picture quality deterioration by operating a thin film transistor for an electro-luminescence cell drive at a non-saturation area to compensate a threshold voltage, and a driving method thereof.

In order to achieve these and other objects of the invention, an electro-luminescence display device according to an aspect of the present invention includes an electro-luminescence cell connected between a first supply voltage source and a ground voltage source to emit light by a current supplied from the first supply voltage source; a cell driver formed every intersection of gate lines and data lines and connected between the first supply voltage source and the electro-luminescence cell to control a current flowing in the pixel cell; and a pulse supplier supplies to the electro-luminescence cell a pulse amplitude modulation signal which is divided to have N (N is a natural number) numbers of different voltage levels from each other, and wherein the driving thin film transistor operates at the non-saturation region.

The electro-luminescence display device further includes a data driver to supply to the data line an on/off signal which is to drive the driving thin film transistor; and a gate driver to supply a scan pulse to the gate line.

The cell driver includes: a switching thin film transistor connected to the gate line, the data line and the driving thin film transistor, to supply the on/off signal on the data line to the gate terminal of the driving thin film transistor; and a storage capacitor connected between the gate terminal of the driving thin film transistor and the first supply voltage source.

The data driver includes: a first resistor and a second resistor connected in series between a second supply voltage source and the ground voltage source; and a first switching device connected between the second resistor and the ground voltage source.

The data driver supplies to the data line a voltage on a node between a first resistor and a second resistor in accordance with the switching of the first switching device and the on/off signal of high state or low state by a voltage difference from the first supply voltage source.

N numbers of pulse signals corresponding to the bit number and having the same duty cycle are supplied to the gate terminal of the first switching device while a scan pulse is supplied to the gate line.

Each of the n numbers of pulse signals has a read section of a first voltage level and a write section of a second voltage level which is different from the first voltage level.

The pulse supplier supplies to a cathode terminal of the electro-luminescence cell the pulse amplitude modulation signal which is synchronized with the n numbers of pulse signals, has the same duty cycle and has n numbers of different voltage levels from each other.

Each of the n numbers of pulse amplitude modulation signals has a read section which is the same as the voltage level from the first supply voltage source and a write section having different voltage levels between the voltage level of the read section and a ground voltage from the ground voltage source.

The driving thin film transistor operates at the non-saturation region-by a voltage difference between the drain-source caused by a voltage supplied to the write section of the n numbers of pulse amplitude modulation signals in relation to a voltage between fixed gate and source terminals.

The electro luminescence cell emits light by a voltage level of a write section of each of the n numbers of pulse amplitude modulation signal and the current corresponding to a voltage difference with the first supply voltage source, and expresses a gray level corresponding to the N bit by the sum of the n numbers of the light-emitting brightness.

A driving method of an electro-luminescence display device having a cell driver inclusive of an electro-luminescence cell which is connected between a first supply voltage source and a ground voltage source to emit light by a current supplied from the first supply voltage source and a driving thin film transistor which is formed at each intersection of gate lines and data lines and connected between the first supply voltage source and the electro-luminescence cell to control a current flowing in the pixel cell, according to another aspect of the present invention includes the steps of: supplying to the electro-luminescence cell a pulse amplitude modulation signal which is divided to have n (n is a natural number) numbers of different voltage levels from one another; and operating the driving thin film transistor at a non-saturation region by the pulse amplitude modulation signal.

The driving method further includes the steps of: generating an on/off signal to drive the driving thin film transistor; and supplying a scan pulse to the gate line.

The step of generating the on/off signal includes: generating n numbers of pulse signals that correspond to the bit number of a digital data and have the same duty cycle while a scan pulse is supplied to the gate line; and generating the on/off signal of high state and low state by use of the pulse signal.

Each of the n number of pulse signals has a read section of a first voltage level and a write section of a second voltage level that is different from the first voltage level.

The pulse amplitude modulation signal is supplied to a cathode terminal of the electro-luminescence cell, is synchronized with the pulse signal, has the same duty cycle and has the n numbers of different voltage levels from each other.

Each of the n numbers of pulse amplitude modulation signals has the same read section as a voltage level from the first supply voltage source, and a write section having a different voltage level from each other between the voltage level of the read section and a ground voltage from the ground voltage source.

The driving thin film transistor operates at the non-saturation region by a voltage difference between the drain and the source by the voltage supplied to the write section of the n numbers of pulse amplitude modulation signal in relation to a voltage between the gate and the source which are fixed.

The electro-luminescence cell emits light by the current corresponding to a voltage difference between the first supply voltage source and a voltage level of a write section of each of the n numbers of pulse amplitude modulation signals, and expresses a gray level corresponding to the n bit by the sum of the light-emitting brightness of each of the n numbers.

An electro-luminescence display device according to still another aspect of the present invention includes an electro-luminescence cell connected between a first supply voltage source and a ground voltage source to emit light by a current supplied from the first supply voltage source; and a cell driver formed at each intersection of gate lines and data lines and connected between the first supply voltage source and the electro-luminescence cell to control a current flowing in the pixel cell, and wherein the driving thin film transistor operates at a non-saturation region.

The electro-luminescence display device further includes: a data driver to supply to the data line an on/off signal which is for driving the driving thin film transistor; a gate driver to supply a scan pulse to the gate line; and a pulse supplier to supply a pulse width modulation signal to the electro-luminescence cell.

The cell driver includes: a switching thin film transistor connected to the gate line and the data line and the driving thin film transistor to supply an on/off signal on the data line to a gate terminal of the driving thin film transistor in response to the scan pulse; and a storage capacitor connected between a gate terminal of the driving thin film transistor and the first supply voltage source.

The data driver includes: a first resistor and a second resistor connected in series between a second supply voltage source and the ground voltage source; a first switching device connected between the second resistor and the ground voltage source.

The data driver supplies to the data line the on/off signal of high state or low state by a voltage difference between the first supply voltage source and a voltage on a node between a first resistor and a second resistor in accordance with the switching of the first switching device.

A modulation data signal having a duty cycle corresponding to the bit number of a digital data and being divided into n steps (n is a natural number) is supplied to a gate terminal of the first switching device while a scan pulse is supplied to the gate line.

A modulation data signal of each of the n steps has a read section of a first voltage level and a write section of a second voltage level which is different from the first voltage level.

The pulse supplier supplies to a cathode terminal of the electro-luminescence cell the pulse width modulation signal which is synchronized with the modulation data signal, has the same duty cycle and is divided into the n steps.

The pulse width modulation signal of each of the n steps has the same read section as a voltage level from the first supply voltage source, and a write section having a level between a ground voltage from the ground voltage source and a voltage level of the read section.

The driving thin film transistor operates at the non-saturation region by a voltage difference between a drain and a source caused by a voltage supplied in a write section of a pulse width modulation signal of each of the n steps in relation to a voltage of a gate and a source which are fixed.

The electro-luminescence cell emits light by the current caused by a voltage difference between the first supply voltage source and a voltage level of a write section of each of the n steps of pulse width modulation signals, and expresses a gray level corresponding to the n bit by the sum of a light-emitting time of each of the n step.

The data driver further includes: a third resistor connected between the second supply voltage source and a node between the first and the second resistors; and a second switching device connected between the third resistor and the second supply voltage source and connects the third resistor in parallel to the first resistor in response to a mode selection signal supplied from the outside.

The data driver supplies to the data line the on/off signal of low state having a first level or high state by a voltage difference between the first supply voltage source and a voltage on a node between a first resistor and a second resistor in accordance with the switching of the first switching device in case the second switching device is turned off by the mode selection signal, and supplies to the data line the on/off signal of low state having a second level or high state by a voltage difference between the first supply voltage source and a voltage on a node between the second resistor and a parallel resistor of the first and second resistors in accordance with the switching of the first switching device in case the second switching device is turned on by the mode selection signal.

The driving thin film transistor has first and second voltages between gate and source which are different in accordance with the on/off signal of low state having the first and second levels.

The driving thin film transistor controls the size of a current flowing in the electro-luminescence cell in 2 levels in accordance with the first and second voltages between gate and source.

A driving method of an electro-luminescence display device having a cell driver inclusive of an electro-luminescence cell which is connected between a first supply voltage source and a ground voltage source and emit light by a current supplied from the first supply voltage source and a driving thin film transistor which is formed at each intersection of gate lines and data lines and connected between the first supply voltage source and the electro-luminescence cell to control a current flowing in the pixel cell, according to still another aspect of the present invention includes the step of: operating the driving thin film transistor at a non-saturation region.

The driving method further includes the steps of: generating an on/off signal to drive the driving thin film transistor; supplying a scan pulse to the gate line; and supplying a pulse width modulation signal to the electro-luminescence cell.

The step of generating the on/off signal includes: generating a modulation data signal which has a duty cycle corresponding to the bit number of a digital data and is divided into n steps (n is a natural number) while a scan pulse is supplied to the gate line; and generating the on/off signal of high state and low state by use of the modulation data signal.

Each of the modulation data signal of the n step has a read section of a first voltage level and a write section of a second voltage level that is different from the first voltage level.

The pulse width modulation signal is synchronized with the modulation data signal, has the same duty cycle, is divided into the n steps, and is supplied to a cathode terminal of the electro-luminescence cell.

Each of the pulse width modulation signals of n step has the same read section as a voltage level from the first supply voltage source, and a write section having a level between the voltage level of the read section and a ground voltage from the ground voltage source.

The driving thin film transistor operates at the non-saturation region by a voltage difference between the drain and the source by the voltage supplied to the write section of each of the pulse width modulation signal of n step in relation to a voltage between the gate and the source which are fixed.

The electro-luminescence cell emits light by the current caused by the voltage difference between the first supply voltage source and a voltage level of a write section of each of the pulse width modulation signals of n step, and expresses a gray level corresponding to the n bit by the sum of the light-emitting time of each of the n steps.

The step of generating the on/off signal includes: generating the on/off signal of low state having a first level or high state by a mode selection signal; and generating the on/off signal of low state having a second level of high state by the mode selection signal.

The driving thin film transistor has first and second voltages between gate and source which are different from each other, in accordance with the on/off signal of low state having the first and second levels.

The driving thin film transistor controls the size of a current flowing in the electro-luminescence cell in 2 levels in accordance with the first and second voltages between gate and source.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 4 to 13.

Figure 1:
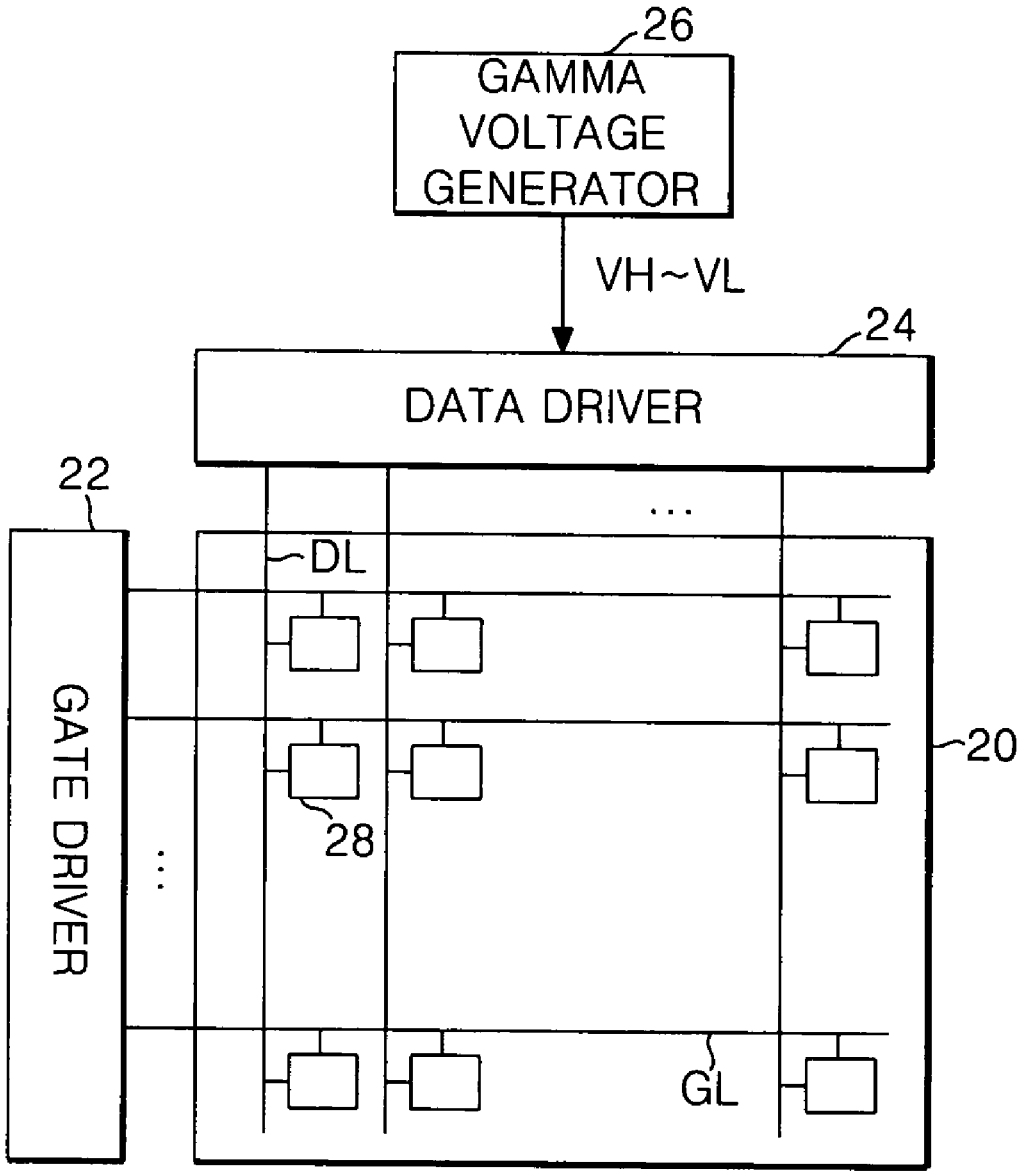
FIG. 1 RELATED ART
FIG. 1 is a block diagram illustrating an electro-luminescence display device of the prior art.
Figure 2:
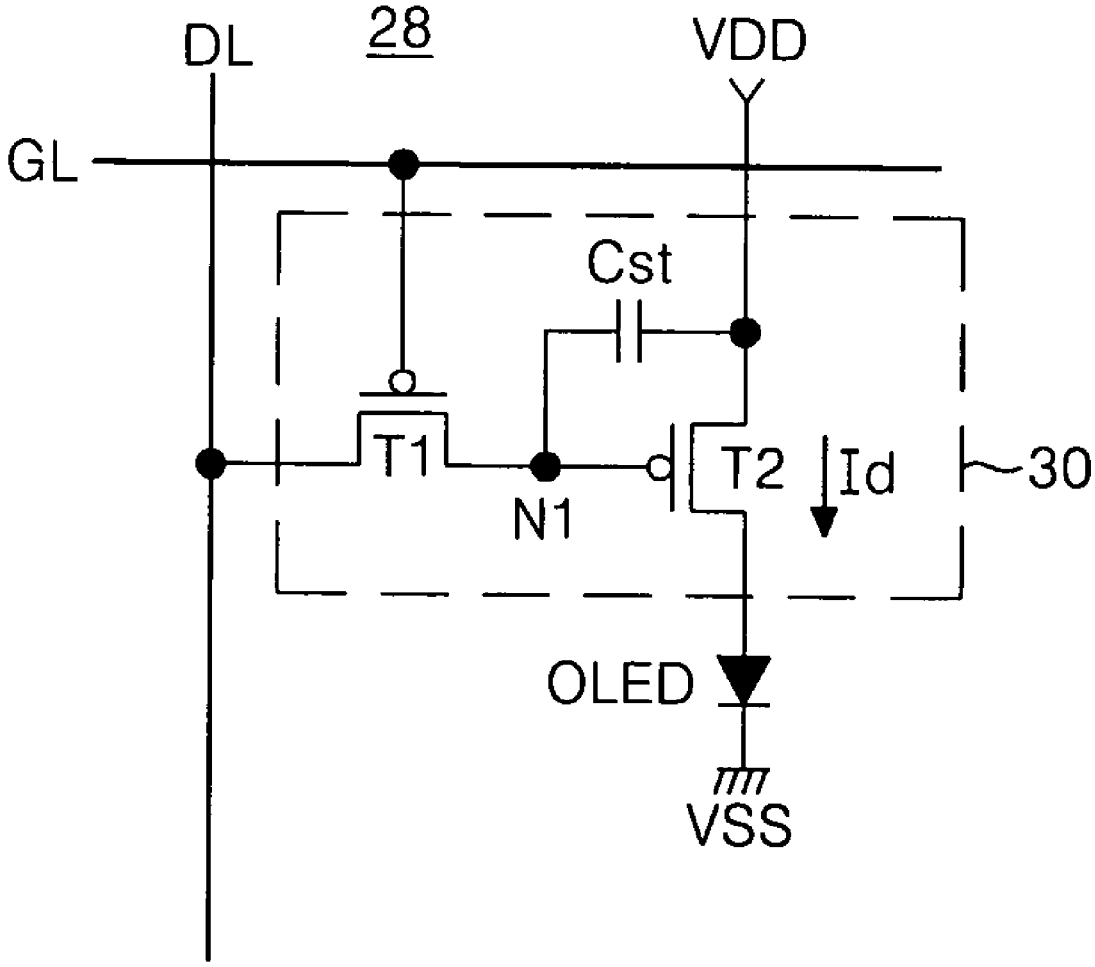
FIG. 2 RELATED ART
FIG. 2 is a circuit diagram illustrating a pixel cell shown in FIG. 1.
Figure 3:
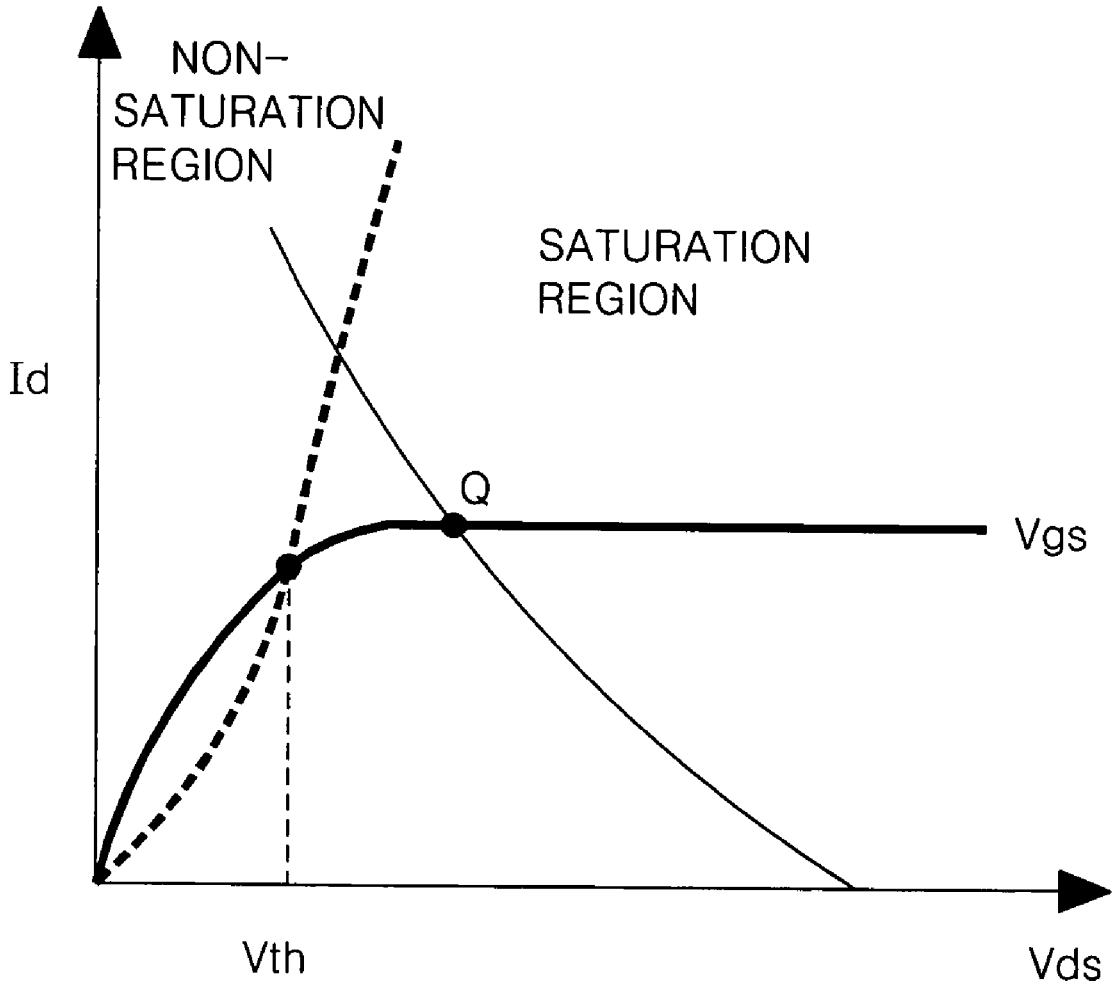
FIG. 3 RELATED ART
FIG. 3 is a diagram representing the operation characteristic of a driving thin film transistor shown in FIG. 2.
Figure 4:
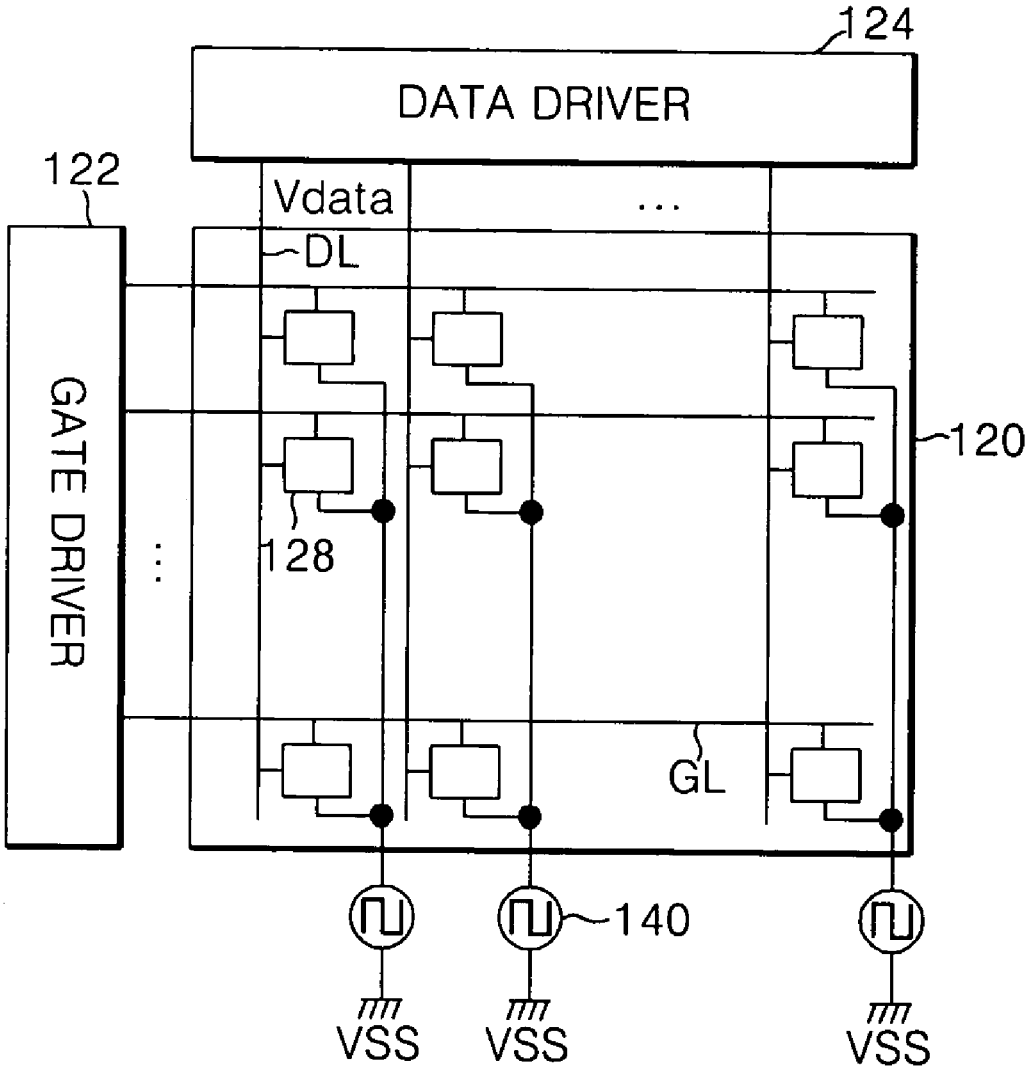
FIG. 4 is a block diagram representing an electro-luminescence display device according to an embodiment of the present invention.
Figure 5:
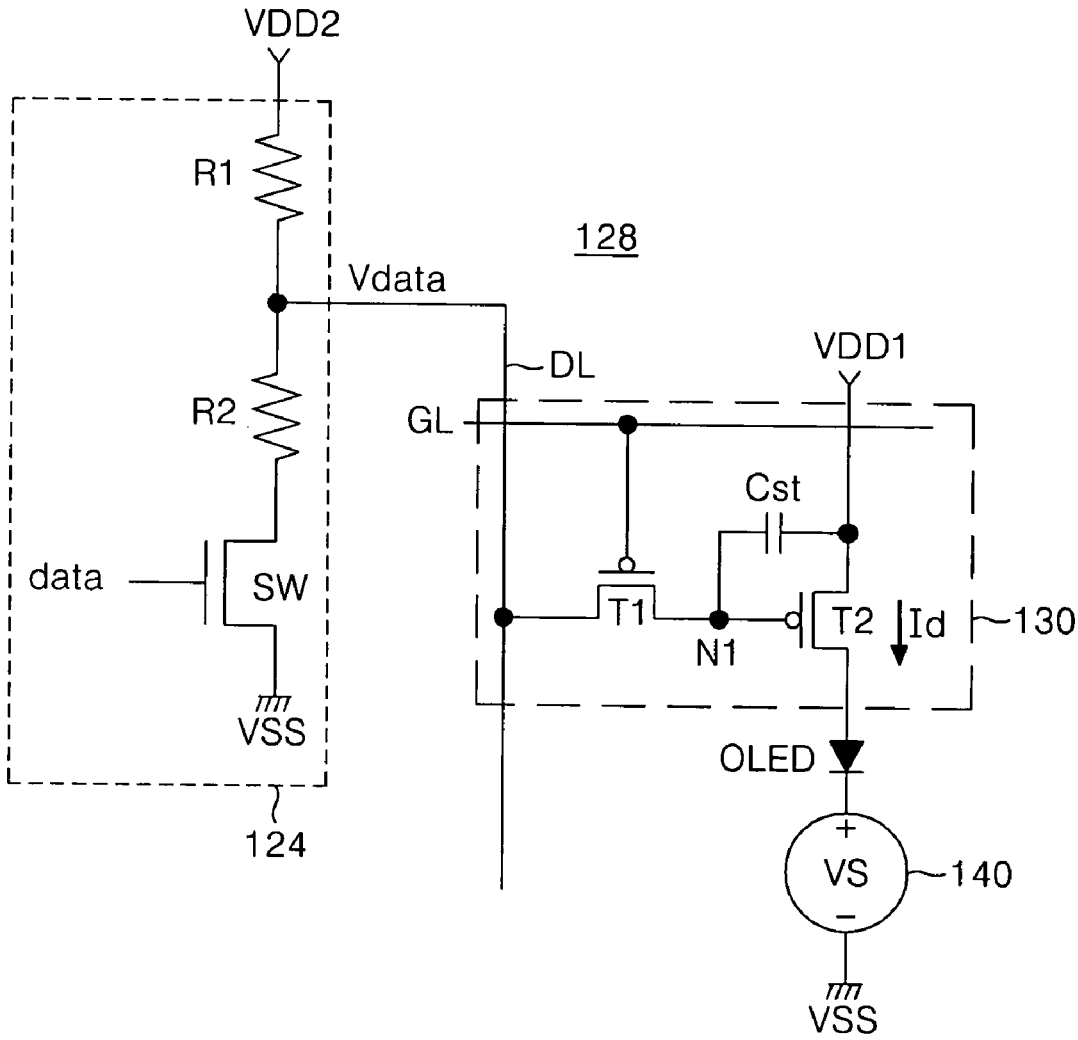
FIG. 5 is a circuit diagram illustrating a pixel cell, a data driver and a pulse supplier of the electro-luminescence display device according to the first embodiment of the present invention shown in FIG. 4.

Referring to FIGS. 4 and 5, an electro-luminescence (hereinafter, referred to as EL) according to a first embodiment of the present invention includes an EL panel 120 having pixel cells 128, inclusive of EL cells OLED and a driving thin film transistor T2 to drive the EL cell OLED, arranged at areas defined by intersections between gate lines GL and data lines DL; a gate driver 122 to drive the gate lines GL of the EL panel 120; a data driver 124 to supply an on/off signal Vdata, which is for driving the pixel cells 128 of the EL panel 120, to the data lines DL; and a pulse supplier 140 to supply a pulse amplitude modulation signal Vs to a cathode electrode of the EL cell OLED, so that the driving thin film transistor T2 is made to operate at the non-saturation region.

The gate driver 122 supplies a scan pulse to the gate lines GL to sequentially drive the gate lines GL.

Each of the pixel cells 128 receives an on/off signal Vdata from the data line DL when a scan pulse is supplied to the gate line GL, to generate a light corresponding to a pulse amplitude modulation signal Vs supplied from the pulse supplier 140.

For this, each of the pixels 128, as shown in FIG. 5, includes an EL cell OLED connected between a first supply voltage source VDD1 and the pulse supplier 140, and a cell driver 130 to drive the EL cell OLED.

The cell driver 130 includes a switching thin film transistor T1, of which a gate terminal is connected to the gate line GL, a source terminal is connected to the data line DL and a drain terminal is connected to a first node N1; a driving thin film transistor T2, of which a gate terminal is connected to the first node N1, a drain terminal is connected to the first supply voltage source VDD1 and a source terminal is connected to an anode of the EL cell OLED; and a storage capacitor Cst connected between the first supply voltage source VDD1 and the first node N1.

The switching thin film transistor T1 supplies the on/off signal Vdata, which is supplied to the data line DL by being turned on when a scan pulse is supplied to the gate line GL, to the first node N1. The on/off signal Vdata supplied to the first node N1 is charged into the storage capacitor Cst as well as being supplied to the gate terminal of the driving thin film transistor T2. The driving thin film transistor T2 is turned on/off in accordance with the on/off signal Vdata supplied to the gate terminal, to control the current amount Id, which is supplied from the first supply voltage source VDD1 through the EL cell OLED. And, even the switching thin film transistor T1 is turned off, the driving thin film transistor T2 remains at the on-state by the on/off signal Vdata charged in the storage capacitor Cst.

The EL cell OLED receives, while the driving thin film transistor T2 is turned on, a pulse amplitude modulation signal Vs supplied to the cathode electrode of itself from the pulse supplier 140 and a current corresponding to the voltage difference from the first supply voltage VDD1 to emit light for a period when it corresponds to the pulse amplitude modulation signal Vs.

The data driver 124 includes a data modulation circuit (not shown) which modulates the digital data inputted from the outside to n (n is a natural number) numbers of pulses corresponding to the bit number; a first resistor and a second resistor R1, R2 connected in series between the second supply voltage source VDD2 and the ground voltage source VSS; and a first switching device SW connected between the second resistor R2 and the ground voltage source VSS. At this moment, the second supply voltage source VDD2 has smaller voltage levels than the first supply voltage source VDD1.

Figure 6:
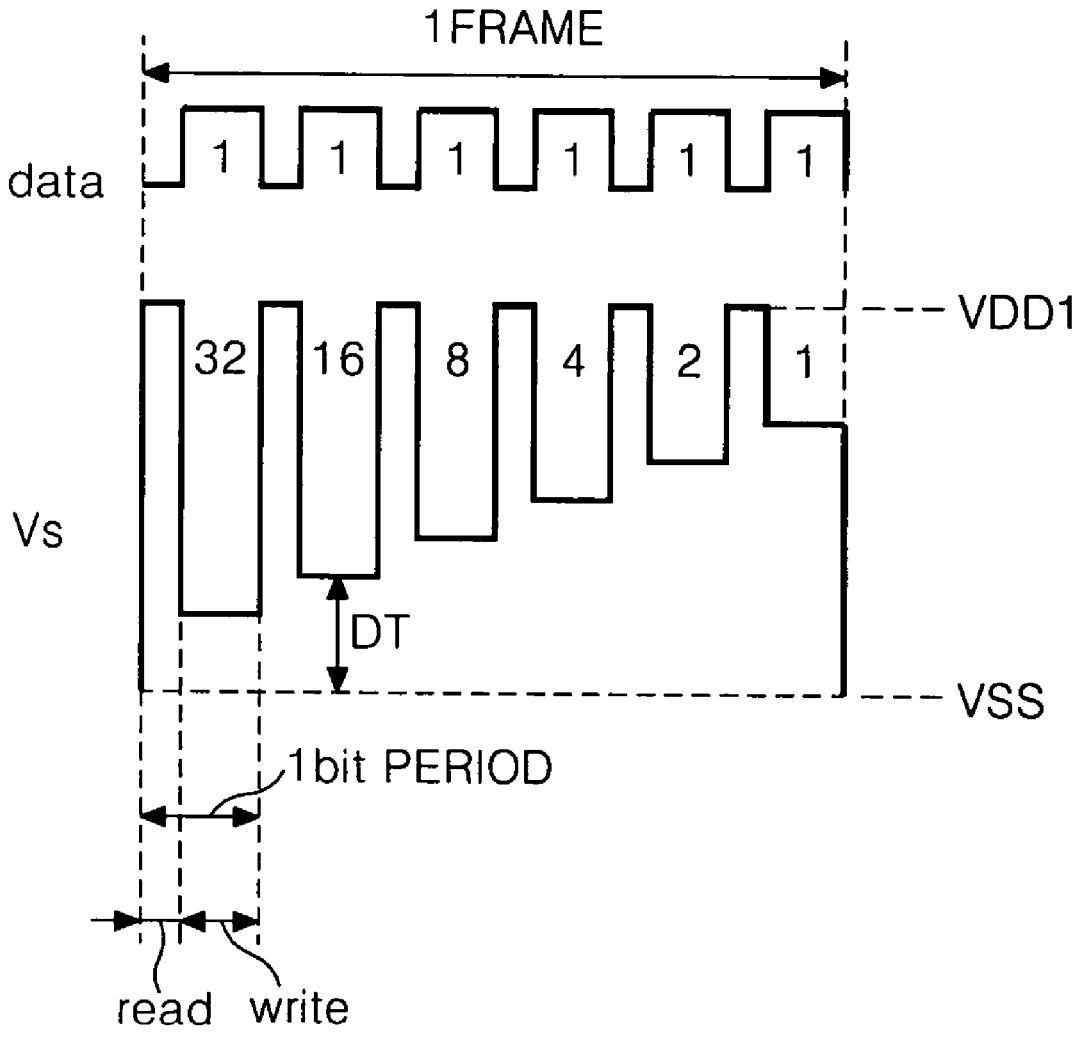
FIG. 6 is a waveform diagram illustrating a pulse amplitude modulation signal supplied to the cathode electrode of an EL cell and a pulse signal supplied to a switching device shown in FIG. 5.

The data modulation circuit modulates the digital data inputted from the outside to n numbers of pulses having the same duty cycle in accordance with the bit number to supply it to the gate terminal of the switching device SW. At this moment, in case that the digital data from the outside is 6 bit, the pulse signal data, as shown in FIG. 6, while the scan pulse is supplied to the gate line GL, is supplied by being divided into 6 steps to have the same duty cycle in accordance with the digital value 0 to 63 corresponding to 6 bit. At this moment, each step of the pulse signal data is divided into a read section for haying the first switching device SW off, and a write section for having the switching device SW on.

The node between the first and second resistors R1, R2 is connected to the data line DL. The first switching device SW selectively connects the second resistor R2 to the ground voltage source VSS in accordance with the pulse signal supplied from the data modulation circuit.

The data driver 124 supplies the voltage from the second supply voltage source VDD2, i.e., the on/off signal Vdata of high state, to the data line DL through the first resistor R1 by having the first switching device SW off by way of the read section of the pulse signal data supplied from the first switching device SW. On the other hand, the data driver 124 connects the second resistor R2 to the ground voltage source VSS by having the first switching device SW on by way of the write section of the pulse signal data supplied from the first switching device SW. Due to this, the on/off signal Vdata of low state is supplied to the data line DL connected to the node between the first and second resistors R1, R2. In other words, in case that the scan pulse is supplied to the gate line GL, the gate terminal of the driving thin film transistor T2 is connected to the ground voltage source VSS through the switching thin film transistor T1, the data line DL, the second resistor R2 of the data driver 124 and the first switching device SW, thus in case that the first switching device SW is the data driver 124 is on, the ground voltage, i.e., the on/off signal Vdata of low state, is supplied to the gate terminal of the driving thin film transistor T2 by the voltage difference between the first supply voltage source VDD1 and the voltage on the node between the first resistor R1 and the second resistor R2.

The pulse supplier 140 is connected between the cathode electrode of the EL cell OLED and the ground voltage source VSS. The pulse supplier 140 supplies the pulse amplitude modulation signal Vs to the cathode electrode of the EL cell OLED, wherein the pulse amplitude modulation signal Vs is synchronized with each step of the pulse signal data supplied to the first switching device SW of the data driver 124 and has the same duty cycle as well as having the voltage levels of n steps corresponding to the bit number of the digital data.

Figure 7:
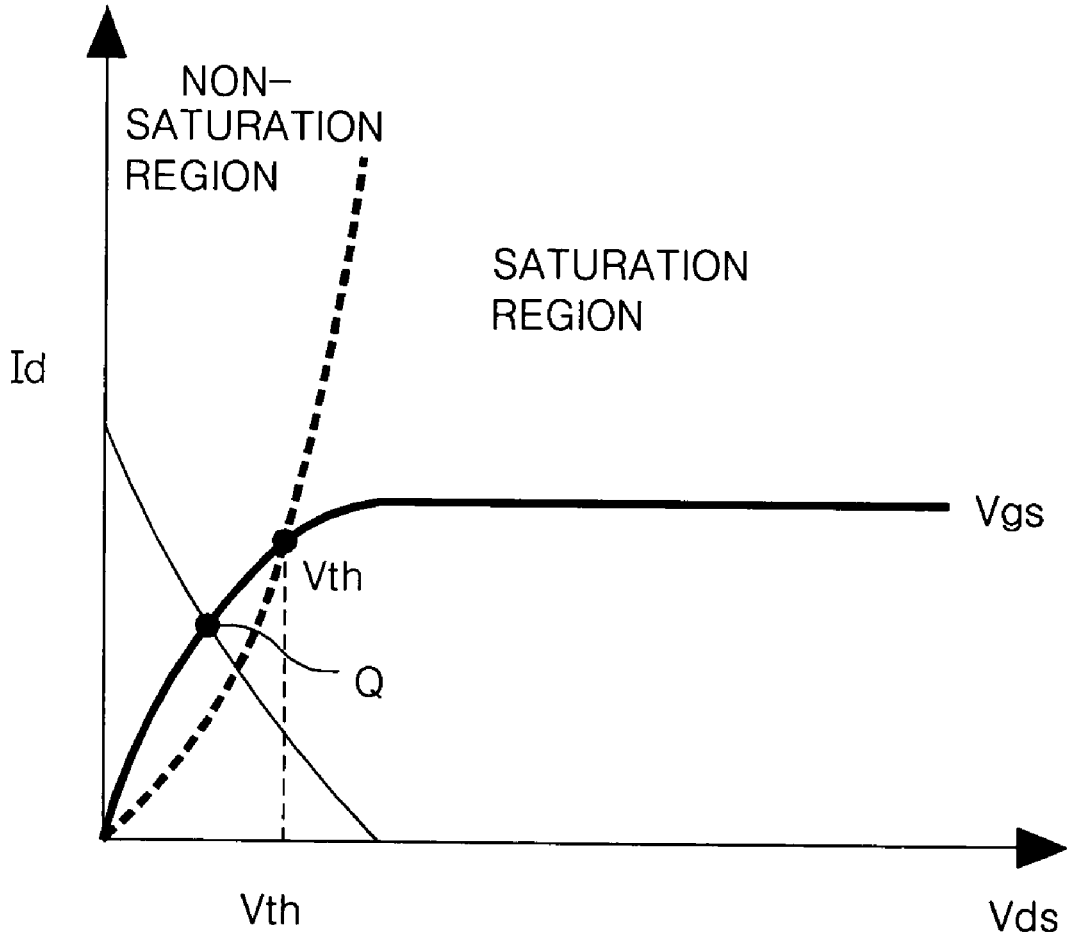
FIG. 7 is a diagram illustrating the operation characteristic of a driving thin film transistor according to the first embodiment of the present invention shown in FIG. 5.

More specifically, the voltage level supplied to the cathode electrode of the EL cell OLED in the read section of the pulse amplitude modulation signal Vs has the same voltage level as the first supply voltage source VDD1, and the voltage supplied to the cathode of the EL cell LED in the write section has the levels of n steps (32, 16, 8, 4, 2, 1) between the first supply voltage source VDD1 and the ground voltage source VSS. Accordingly, the voltage level between the ground voltage source and the first supply voltage source VDD1 supplied in the write section of the pulse amplitude modulation signal Vs, while the voltage Vgs of the source terminal and the gate terminal of the driving thin film transistor T2 is fixed by the data driver 124, changes the voltage Vds of the source terminal and the drain terminal of the driving thin film transistor T2 to the level of n steps (32, 16, 8, 4, 2, 1), thus the operating point Q of the driving thin film transistor T2 is made to be in a non-saturation region as shown in FIG. 7. Accordingly, the EL display device and the driving method thereof according to the first embodiment of the present invention has the operation point Q of the driving thin film transistor T2 in the non-saturation region, thus the change amount of the current Id flowing in the driving thin film transistor T2 by the deviation of the threshold voltage Vth can be made smaller than the prior art in relation to the fixed Vgs supplied from the data driver 124. As a result, the EL display device and the driving method thereof according to the first embodiment of the present invention can prevent picture quality deterioration by compensating the deviation of the threshold voltage Vth of the driving thin film transistor T2.

At the same time, the EL cell OLED receives the voltage from the first supply voltage source VDD1 supplied through the driving thin film transistor T2 and the current from the first supply voltage source VDD1 by the voltage difference DT from the pulse supplier 140, thereby emitting light. Accordingly, the EL cell OLED expresses the gray level corresponding to the bit number of the digital data by the sum of the light-emitting brightness of n step by the pulse amplitude modulation signal supplied step by step from the pulse supplier 140 so as to be synchronized with the on/of signal Vdata supplied by steps from the data driver 124 during the period when the scan pulse is supplied to the gate line GL.

Figure 8:
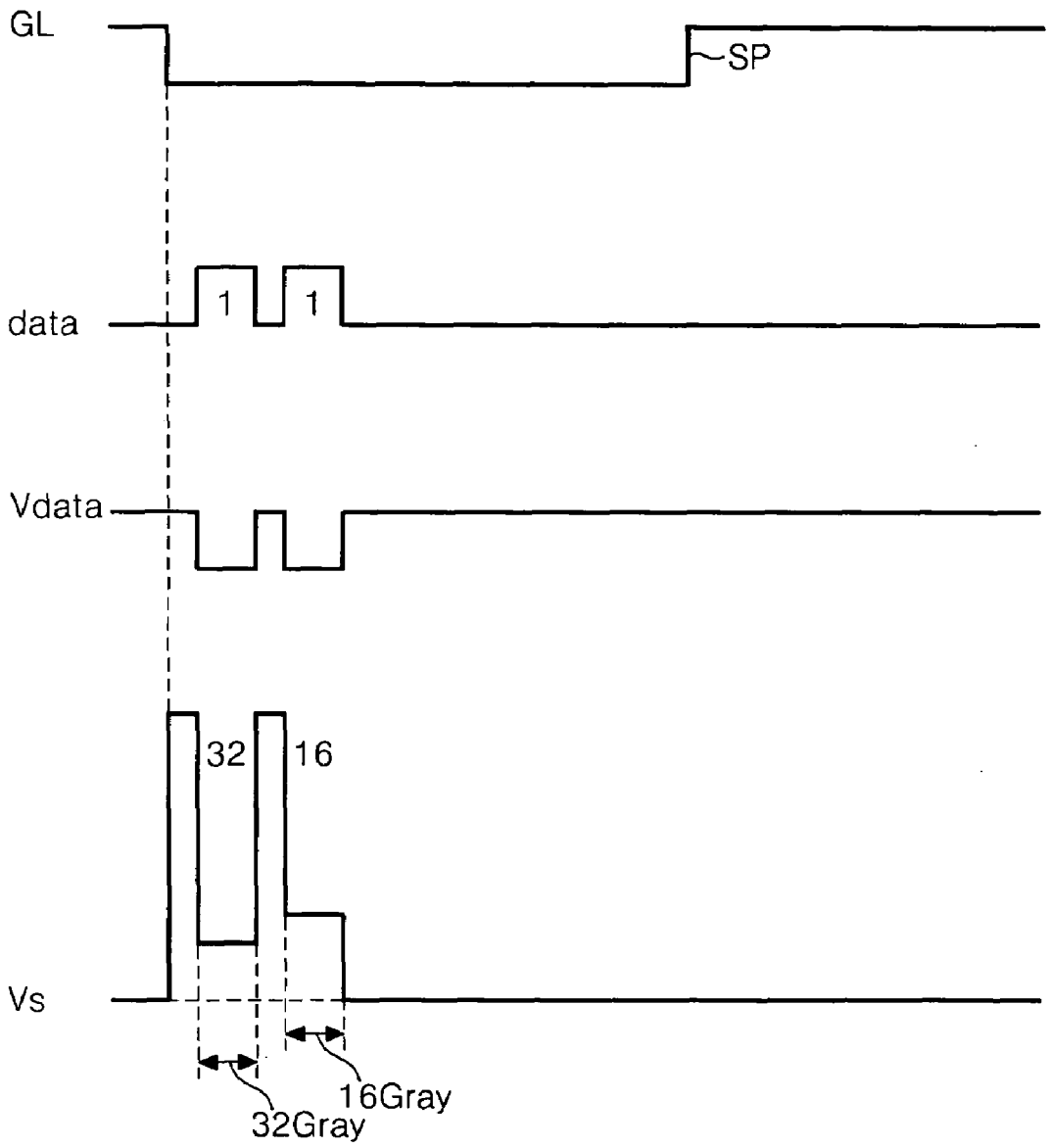
FIG. 8 is a drive waveform diagram for expressing forty eight gray levels in a pixel cell shown in FIG. 5.

In the EL display device and the driving method thereof according to the first embodiment of the present invention, as shown in FIG. 8, in case that the digital data supplied from the outside is 6 bit and 48 gray levels are expressed in one EL cell OLED by use of the 6 bit digital data, an example is described as follows.

The data driver 124 sequentially supplies the pulse signal of first step corresponding to the digital data (100000) of 32 and the pulse signal of second step corresponding to the digital data (010000) of 16 subsequent to the first step to the switching device SW while the scan pulse SP is supplied to the gate line GL. Accordingly, the switching device SW sequentially supplies the on/off signal Vdata to the gate terminal of the driving thin film transistor T2 through the switching thin film transistor T1, in response to each of the pulse signals of the first and second steps sequentially supplied from the data driver 124, and at the same time the pulse amplitude modulation signal 32 of first step being synchronized with each of the pulse signals of the first and second steps from the pulse supplier 140 and having the voltage level corresponding to the digital data (100000) of 32 and the pulse amplitude modulation signal 16 of second step having the voltage level corresponding to the digital data (010000) of 16 are supplied step by step to the cathode electrode of the EL cell OLED.

Because of this, the driving thin film transistor T2 is turned on by the on/off signal Vdata sequentially supplied by the first and second steps, to control the current amount Id supplied from the first supply voltage source VDD1 through the EL cell OLED. At this moment, the EL cell OLED receives the voltage levels (32, 16) of each of the pulse amplitude modulation signals (32, 16) of the first and second steps supplied to the cathode electrode of itself and the current corresponding to the voltage difference with the first supply voltage source VDD1 and is made to emit light step by step.

Accordingly, the EL display device and the driving method thereof according to the first embodiment of the present invention has the EL cell OLED emit light by the first and second steps, thus the 48 gray levels are expressed by the sum of the light-emitting brightness 32 of the first step and the light-emitting brightness 16 of the second step.

Hereinafter, referring to FIGS. 9 to 11, the second embodiment of the present invention is described. Herein, the second embodiment includes the contents of FIGS. 4 and 5 of the first embodiment as it is, thus it will be described in conjunction with FIGS. 4 and 5 without separate drawings.

Figure 9:
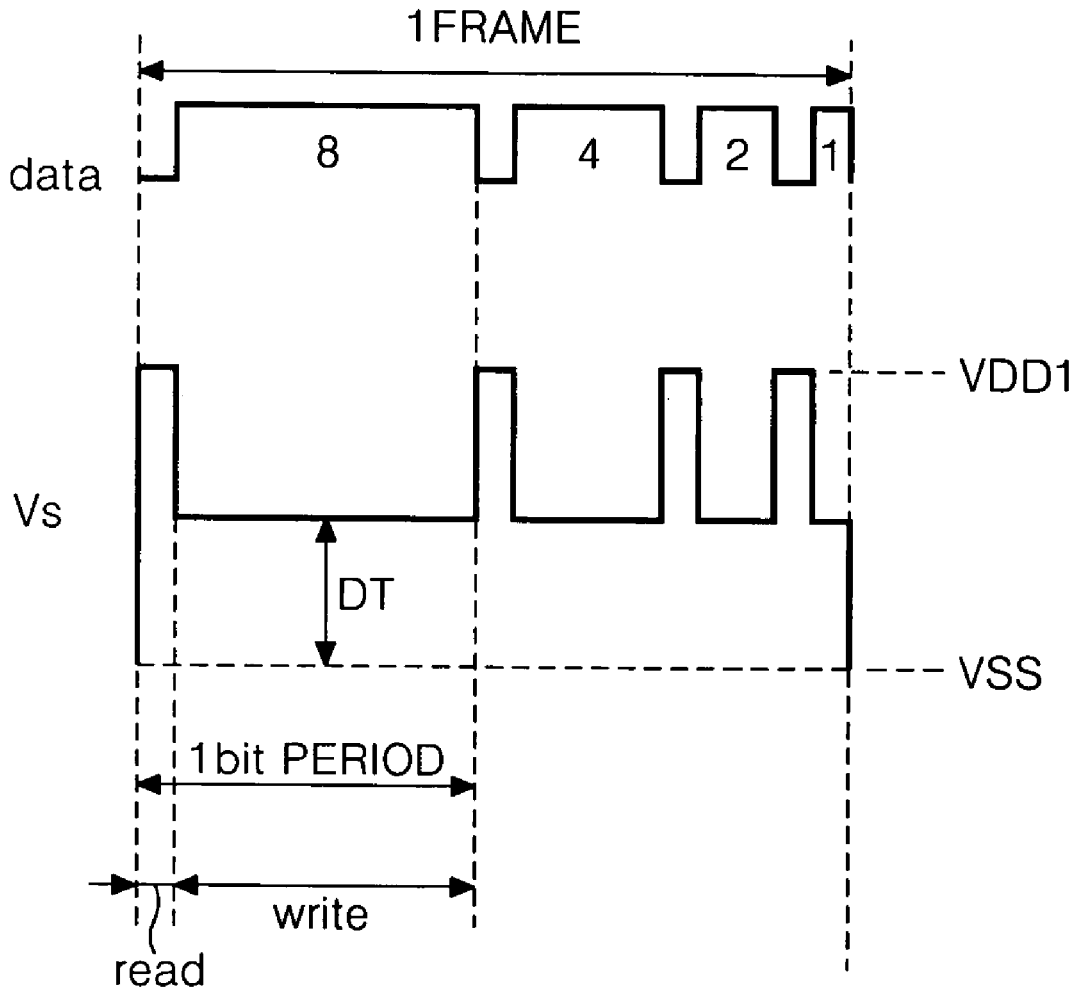
FIG. 9 is a waveform diagram illustrating a pulse amplitude modulation signal supplied to the cathode electrode of an EL cell and a modulation data signal according to a second embodiment of the present invention.
Figure 10:
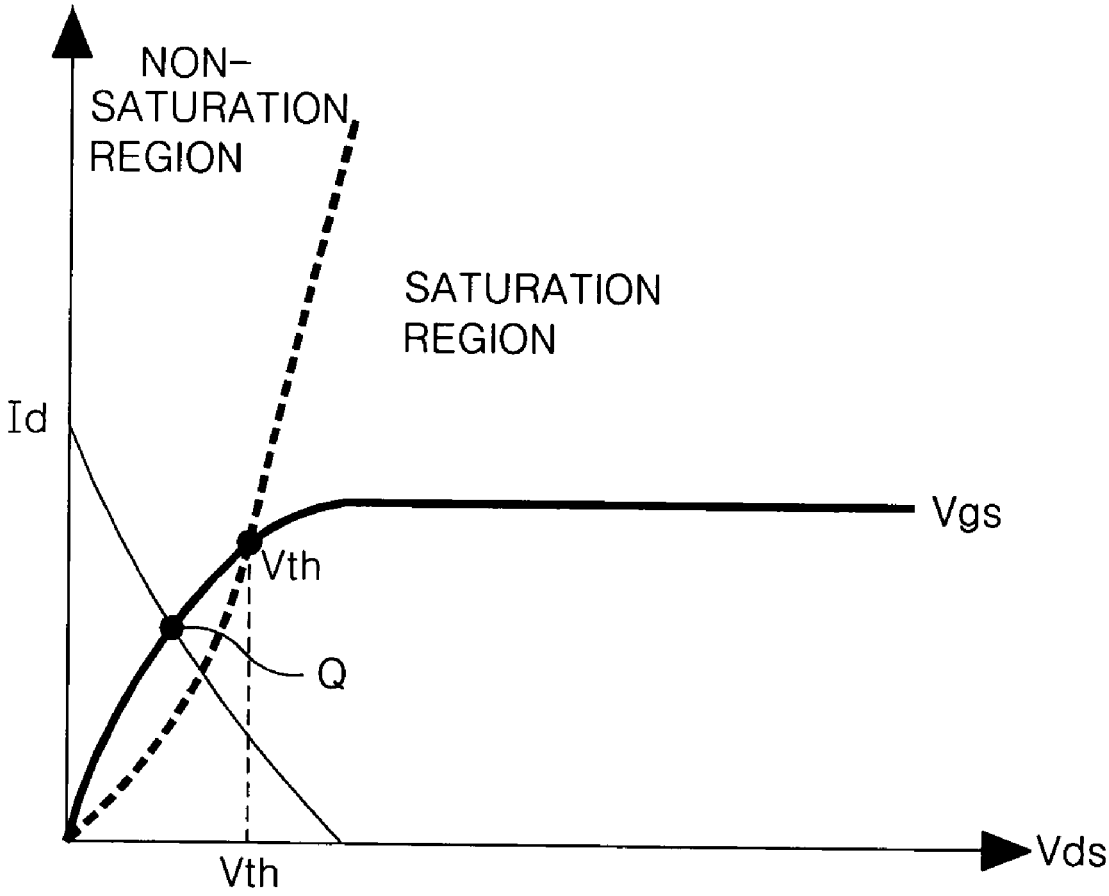
FIG. 10 is a diagram illustrating the operation characteristic of a driving thin film transistor according to the second embodiment of the present invention.

FIG. 9 is a waveform diagram representing a modulation data signal supplied to a switching device and a pulse width modulation signal supplied to the cathode electrode of the EL cell, shown in FIG. 5. FIG. 10 is a diagram illustrating an operation characteristic of a driving thin film transistor. FIG. 11 is a drive waveform diagram for expressing 12 gray levels in a pixel cell shown in FIG. 5.

Referring to FIGS. 4, 5, 9 and 11, an electro-luminescence (hereinafter, referred to as EL) according to a second embodiment of the present invention includes an EL panel 120 having pixel cells 128, inclusive of EL cells OLED and a driving thin film transistor T2 to drive the EL cell OLED, arranged at areas defined by intersections between gate lines GL and data lines DL; a gate driver 122 to drive the gate lines GL of the EL panel 120; a data driver 124 to supply an on/off signal Vdata, which is for driving the pixel cells 128 of the EL panel 120, to the data lines DL; and a pulse supplier 140 to supply a pulse width modulation signal Vs to a cathode electrode of the EL cell OLED, so that the driving thin film transistor T2 is made to operate at the non-saturation region.

The gate driver 122 supplies a scan pulse to the gate lines GL to sequentially drive the gate lines GL.

Each of the pixel cells 128 receives an on/off signal Vdata from the data line DL when a scan pulse is supplied to the gate line GL, to generate a light corresponding to a pulse width modulation signal Vs supplied from the pulse supplier 140.

For this, each of the pixels 128, as shown in FIG. 5, includes an EL cell OLED connected between a first supply voltage source VDD1 and the pulse supplier 140, and a cell driver 130 to drive the EL cell OLED.

The cell driver 130 includes a switching thin film transistor T1, of which a gate terminal is connected to the gate line GL, a source terminal is connected to the data line DL and a drain terminal is connected to a first node N1; a driving thin film transistor T2, of which a gate terminal is connected to the first node N1, a drain terminal is connected to the first supply voltage source VDD1 and a source terminal is connected to an anode of the EL cell OLED; and a storage capacitor Cst connected between the first supply voltage source VDD1 and the first node N1.

The switching thin film transistor T1 supplies the on/off signal Vdata, which is supplied to the data line DL by being turned on when a scan pulse is supplied to the gate line GL, to the first node N1. The on/off signal Vdata supplied to the first node N1 is charged into the storage capacitor Cst as well as being supplied to the gate terminal of the driving thin film transistor T2. The driving thin film transistor T2 is turned on/off in accordance with the on/off signal Vdata supplied to the gate terminal, to control the current amount Id, which is supplied from the first supply voltage source VDD1 through the EL cell OLED. And, even the switching thin film transistor T1 is turned off, the driving thin film transistor T2 remains at the on-state by the on/off signal Vdata charged in the storage capacitor Cst.

The EL cell OLED receives, while the driving thin film transistor T2 is turned on, a pulse width modulation signal Vs supplied to the cathode electrode of itself from the pulse supplier 140 and a current corresponding to the voltage difference from the first supply voltage VDD1 to emit light for a period when it corresponds to the pulse width modulation signal Vs.

The data driver 124 includes a data modulation circuit (not shown) which modulates it to have a duty cycle of n step (n is a natural number) corresponding to the bit number of the digital data inputted from the outside; a first resistor and a second resistor R1, R2 connected in series between the second supply voltage source VDD2 and the ground voltage source VSS; and a first switching device SW connected between the second resistor R2 and the ground voltage source VSS. At this moment, the second supply voltage source VDD2 has smaller voltage levels than the first supply voltage source VDD1.

The data modulation circuit modulates the digital data inputted from the outside to have the duty cycle of n step corresponding to the bit number to supply it to the gate terminal of the first switching device SW. At this moment, in case that the digital data from the outside is 4 bit, the modulation data signal data, as shown in FIG. 9, while the scan pulse is supplied to the gate line GL, is supplied by being divided to have the duty cycle of 4 step (8, 4, 2, 1) in accordance with the digital value 0 to 15 corresponding to 4 bit. At this moment, each step of the modulation data signal data is divided into a read section for having the first switching device SW off, and a write section for having the first switching device SW on. Accordingly, the 16 gray levels are expressed by the sum of the gray levels expressed by the 4 step (8, 4, 2, 1) of the modulation data signal data. In other words, among the 4 step (8, 4, 2, 1), the first step expresses 8 gray levels, the second step expresses 4 gray levels, the third step expresses 2 gray levels and the fourth step expresses 1 gray level.

The node between the first and second resistors R1, R2 is connected to the data line DL. The first switching device SW selectively connects the second resistor R2 to the ground voltage source VSS in accordance with the modulation data signal data supplied from the data modulation circuit.

The data driver 124 supplies the voltage from the second supply voltage source VDD2, i.e., the on/off signal Vdata of high state, to the data line DL through the first resistor R1 by having the first switching device. SW off by way of the read section of the modulation data signal data supplied from the first switching device SW. On the other hand, the data driver 124 connects the second resistor R2 to the ground voltage source VSS by having the first switching device SW on by way of the write section of the modulation data signal data supplied from the first switching device SW. Due to this, the on/off signal Vdata of low state is supplied to the data line DL connected to the node between the first and second resistors R1, R2. In other words, in case that the scan pulse is supplied to the gate line GL, the gate terminal of the driving thin film transistor T2 is connected to the ground voltage source VSS through the switching thin film transistor T1, the data line DL, the second resistor R2 of the data driver 124 and the first switching device SW, thus in case that the first switching device SW is the data driver 124 is on, the ground voltage, i.e., the on/off signal Vdata of low state, is supplied to the gate terminal of the driving thin film transistor T2 by the voltage difference between the first supply voltage source VDD1 and the voltage on the node between the first resistor R1 and the second resistor R2.

The pulse supplier 140 is connected between the cathode electrode of the EL cell OLED and the ground voltage source VSS. The pulse supplier 140 supplies the pulse width modulation signal Vs to the cathode electrode of the EL cell OLED, wherein the pulse width modulation signal Vs is synchronized with each step of the modulation data signal data supplied to the switching device SW of the data driver 124 and has the same duty cycle.

More specifically, the voltage level supplied to the cathode electrode of the EL cell OLED in the read section of the pulse width modulation signal Vs has the same voltage level as the first supply voltage source VDD1, and the voltage level supplied to the cathode of the EL cell OLED in the write section has the voltage level between the first supply voltage source VDD1 and the ground voltage source VSS. Accordingly, the voltage level between the ground voltage source and the first supply voltage source VDD1 supplied in the write section of the pulse width modulation signal Vs, while the voltage Vgs of the source terminal and the gate terminal of the driving thin film transistor T2 is fixed by the data driver 124, makes the voltage Vds of the source terminal and the drain terminal of the driving thin film transistor T2 small, thus the operating point Q of the driving thin film transistor T2 is made to be in a non-saturation region as shown in FIG. 10. Accordingly, the EL display device and the driving method thereof according to the second embodiment of the present invention has the operation point Q of the driving thin film transistor T2 in the non-saturation region, thus the change amount of the current Id flowing in the driving thin film transistor T2 by the deviation of the threshold voltage Vth can be made smaller than the prior art in relation to the fixed Vgs supplied from the data driver 124. As a result, the EL display device and the driving method thereof according to the second embodiment of the present invention can prevent picture quality deterioration by compensating the deviation of the threshold voltage Vth of the driving thin film transistor T2.

At the same time, the EL cell OLED receives the voltage from the first supply voltage source VDD1 supplied through the driving thin film transistor T2 and the current from the first supply voltage source VDD1 by the voltage difference DT from the pulse supplier 140, thereby emitting light. Accordingly, the EL cell OLED expresses the gray level corresponding to the bit number of the digital data by the sum of the light-emitting time of n step by the pulse width modulation signal supplied step by step from the pulse supplier 140 so as to be synchronized with the on/of signal Vdata supplied by steps from the data driver 124 during the period when the scan pulse is supplied to the gate line GL.

Figure 11:
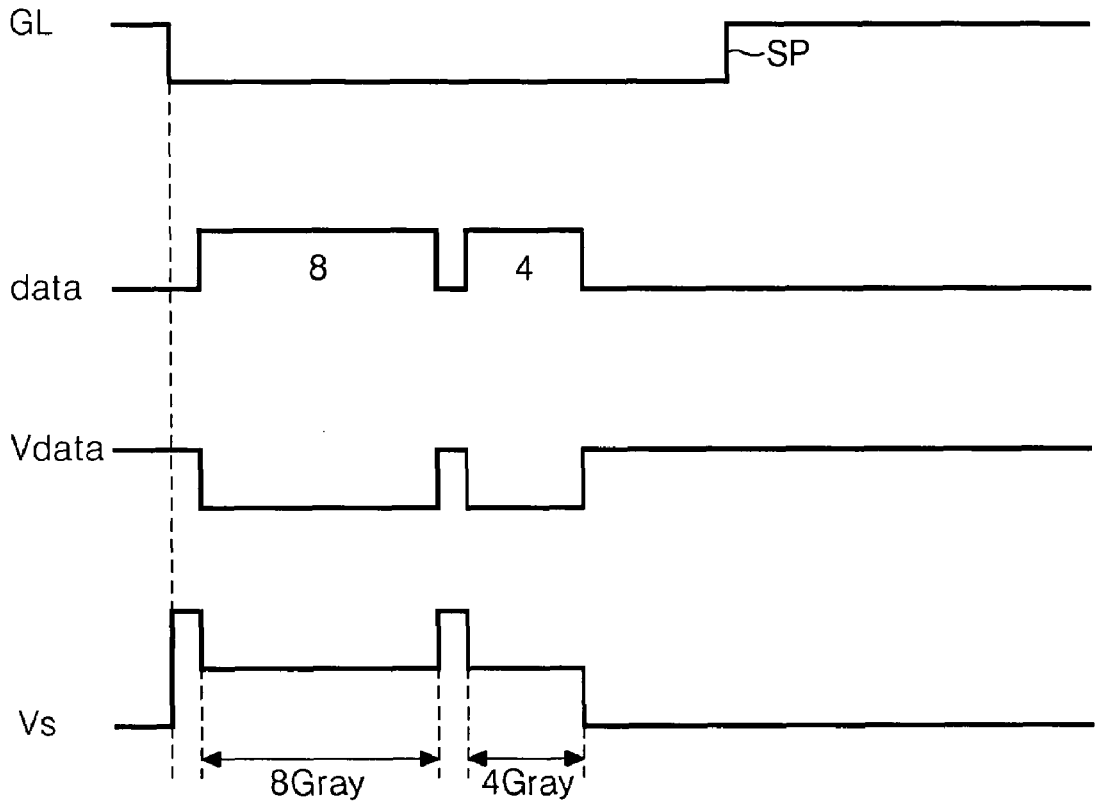
FIG. 11 is a drive waveform diagram for expressing twelve gray levels in a pixel cell shown in FIG. 5.

In the EL display device and the driving method thereof according to the second embodiment of the present invention, as shown in FIG. 11, in case that the digital data supplied from the outside is 4 bit and 12 gray levels are expressed in one EL cell OLED by use of the 4 bit digital data, an example is described as follows.

The data driver 124 sequentially supplies the modulation data signal (8) of first step having the duty cycle corresponding to the digital data (1000) of 8 and the modulation data signal (4) of second step having the duty cycle corresponding to the digital data (0100) of 4 subsequent to the first step to the switching device SW while the scan pulse SP is supplied to the gate line GL. Accordingly, the switching device SW sequentially supplies the on/off signal Vdata to the gate terminal of the driving thin film transistor T2 through the switching thin film transistor T1, in response to each of the modulation data signals (8, 4) of the first and second steps sequentially supplied from the data driver 124, and at the same time the pulse width modulation signal Vs of first and second steps being synchronized with each of the modulation data signals (8, 4) of the first and second steps from the pulse supplier 140 and having the same duty cycle are supplied step by step to the cathode electrode of the EL cell OLED.

Because of this, the driving thin film transistor T2 is turned on by the on/off signal Vdata sequentially supplied by the first and second steps, to control the current amount Id supplied from the first supply voltage source VDD1 through the EL cell OLED. At this moment, the EL cell OLED emits light for the duty cycle of each of the pulse width modulation signals Vs of the first and second steps supplied to the cathode electrode of itself.

Accordingly, the EL display device and the driving method thereof according to the second embodiment of the present invention has the EL cell OLED emit light by the first and second steps while the scan pulse SP is supplied to the gate line GL, thus 12 gray levels are expressed by the sum of 8 gray levels by the light-emitting time of the first step and 4 gray levels by the light-emitting time of the second step.

Figure 12:
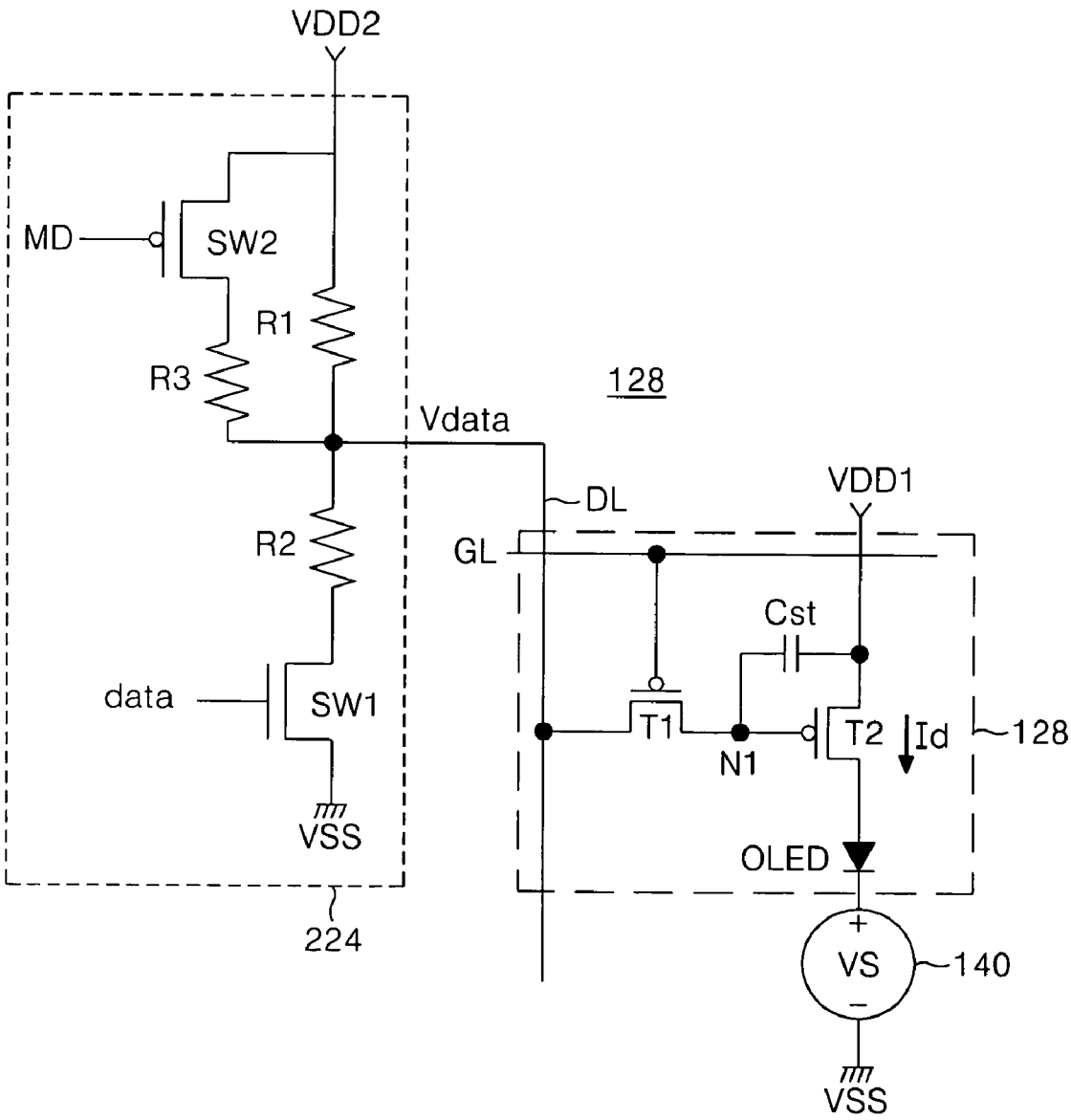
FIG. 12 is a circuit diagram illustrating a pixel cell, a data driver and a pulse supplier of the electro-luminescence display device according to the third embodiment of the present invention.

Referring to FIG. 12, an EL display device according to a third embodiment of the present invention is the same as the EL display device according to the second embodiment of the present invention except the data driver 224. Accordingly, in the EL display device according to the third embodiment of the present invention, the description of the EL display device according to the second embodiment of the present invention will substitute for the description for the components except the data driver 224.

The EL display device according to the third embodiment of the present invention controls the brightness of the EL panel 120 in accordance with the mode selection signal MD. At this moment, the mode selection signal MD becomes high state in case of bright mode, and the mode selection signal MD becomes low state in case of dark mode.

For this, the data driver 224 of the EL display device according to the third embodiment of the present invention includes a data modulation circuit (not shown) to modulate the digital data inputted from the outside to have a duty cycle of n step (n is a natural number) corresponding to the bit number, a first resistor and a second resistor R1, R2 connected in series between the second supply voltage source VDD2 and the ground voltage source VSS, a first switching device SW1 connected between the second resistor R2 and the ground voltage source VSS, a, second switching device SW2 connected between the second supply voltage source VDD2 and a node between the first resistor R1 and the second resistor R2, and a third resistor R3 connected between the second switching device SW2 and a node between the first resistor R1 and the second resistor R2.

The data modulation circuit modulates the digital data inputted from the outside to have the duty cycle of n step corresponding to the bit number, and supplies it to the gate terminal of the switching device SW. At this moment, in case that the digital data from the outside is 4 bit, the modulation data signal data, as shown in FIG. 9, is supplied by being divided to have the duty cycle of 4 steps (8, 4, 2, 1) in accordance with the digital value 0 to 15 corresponding to the 4 bit while the scan signal is supplied to the gate line GL. At this moment, each step of the modulation data signal data is divided into a read section for having the switching device SW off and a write section for having the switching device SW on. Accordingly, the 16 gray levels are expressed by the sum of the gray levels expressed by the 4 step (8, 4, 2, 1) of the modulation data signal data. In other words, among the 4 step (8, 4, 2, 1), the first step expresses 8 gray levels, the second step expresses 4 gray levels, the third step expresses 2 gray levels and the fourth step expresses 1 gray level.

The node between the first and second resistors R1, R2 is connected to the data line DL. The third resistor R3 is selectively connected in parallel to the first resistor R1 in accordance with the switching of the second switching device SW2.

The first switching device SW1 selectively connects the second resistor R2 to the ground voltage source VSS in accordance with the modulation data signal data supplied from the data modulation circuit. The second switching device SW2 is switched by an inputted mode selection signal MD to selectively connects the third resistor R3 in parallel to the first resistor R1.

The data driver 224 turns off the first switching device SW1 by the read section of the modulation data signal data supplied to the first switching device SW1 to supply the voltage from the second supply voltage source VDD2, i.e., the on/off signal Vdata of high state, to the data line DL through the first resistor R1.

On the other hand, the data driver 224 turns on the first switching device SW1 by the write section of the modulation data signal data supplied to the first switching device SW1 when the second switching device SW2 is turned off by the mode selection signal MD of high state, thereby connecting the second resistor R2 to the ground voltage source VSS. Because of this, the on/off signal Vdata of low state having the first step is supplied to the data line DL connected to the node between the first and second resistors R1, R2. In other words, the gate terminal of the driving thin film transistor T2 is connected to the ground voltage source VSS through the switching thin film transistor T1, the data line DL, the second resistor R2 of the data driver 224 and the first switching device SW1 when the scan pulse is supplied to the gate line GL, thus the ground voltage, i.e., the on/off signal Vdata of low state having the first level is supplied to the gate terminal of the driving thin film transistor T2 by the voltage difference between the first voltage source VDD1 and the voltage on the node between the first resistor R1 and the second resistor R2 when the first switching device SW1 of the data driver 224 is turned on.

On the other hand, the data driver 224 turns on the first switching device SW1 by the write section of the modulation data signal data supplied to the first switching device SW1 when the second switching device SW2 is turned on by the mode selection signal MD of low state, thereby connecting the second resistor R2 to the ground voltage source VSS and in addition connects the third resistor R3 to the first resistor R1 in parallel by the second switching device SW2. Because of this, the on/off signal Vdata of low state having the second level different from the first level is supplied to the data line DL connected to the node between the first and second resistors R1, R2. In other words, the gate terminal of the driving thin film transistor T2 is connected to the ground voltage source VSS through the switching thin film transistor T1, the data line DL, the second resistor R2 of the data driver 224 and the first switching device SW1 when the scan pulse is supplied to the gate line GL, thus the ground voltage, i.e., the on/off signal Vdata of low state having the second level is supplied to the gate terminal of the driving thin film transistor T2 by the voltage difference between the first voltage source VDD1 and the voltage on the node between the second resistor R2 and the parallel resistor of the first resistor R1 and the third resistor R3 when the first switching device SW1 of the data driver 224 is turned on.

Figure 13:
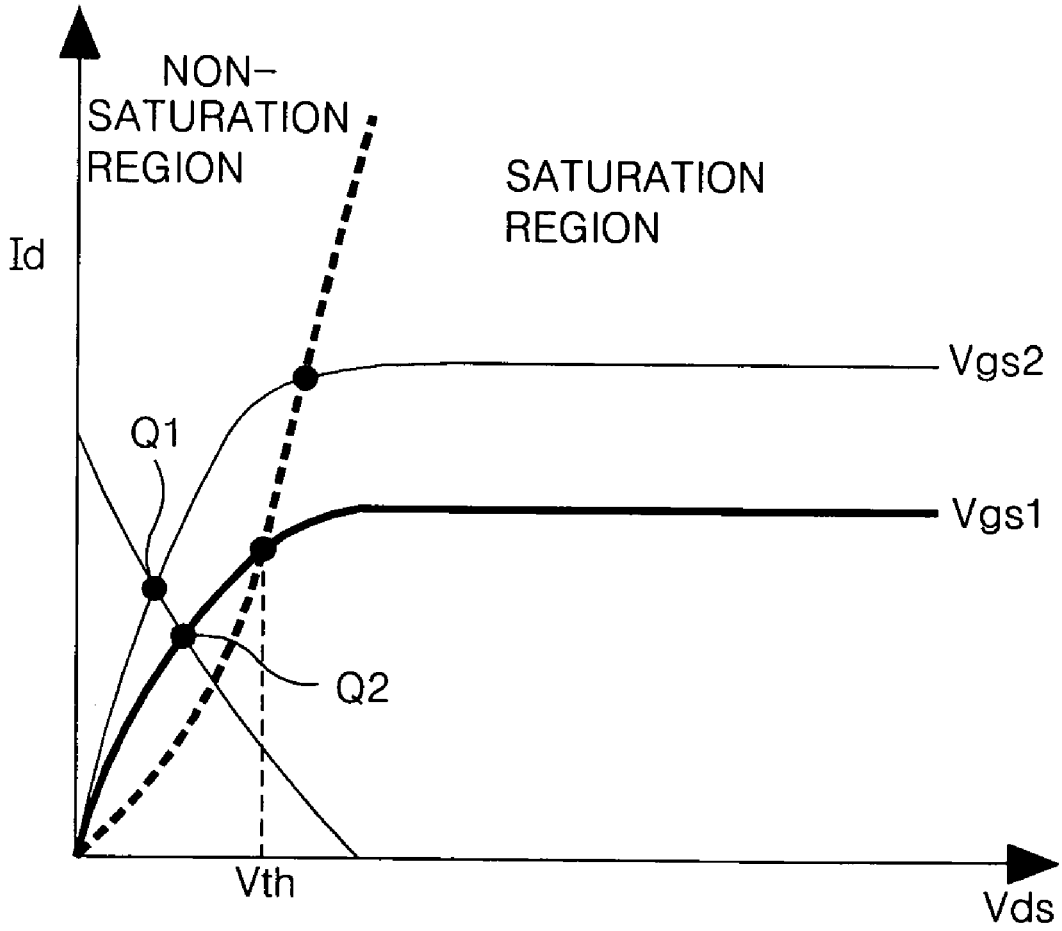
FIG. 13 is a diagram illustrating the operation characteristic of a driving thin film transistor according to the third embodiment of the present invention shown in FIG. 12.

The EL display device and the driving method thereof according to the third embodiment of the present invention selectively supplies the on/off signal Vdata of low state having the first and second levels to the gate terminal of the driving thin film transistor T2 of the pixel cell 128 in accordance with the mode selection signal MD, thereby enabling to make the voltage Vgs of the gate terminal and the source terminal of the driving thin film transistor T2 changed to two levels Vgs1, Vgs2 as shown in FIG. 13. And, the EL display device and the driving method thereof according to the third embodiment of the present invention supplies the pulse width modulation signal Vs having the duty cycle of n step in accordance with the digital data to the cathode electrode of the EL cell OLED as described in the first embodiment of the present invention, thus the voltage Vds of the drain terminal and the source terminal of the driving thin film transistor T2 is made to be small while the voltage Vgs of the gate terminal and the source terminal of the thin film transistor T2 is fixed to two levels Vgs1, Vgs2, thereby enabling the operation points Q1, Q2 of the driving thin film transistor T2 to be in the non-saturation region as shown in FIG. 13. Accordingly, the EL display device and the driving method thereof according to the third embodiment of the present invention can make the change amount of the current Id flowing in the drivin thin film transistor T2 caused by the deviation of the threshold voltage Vth smaller than the prior art, in relation to the fixed Vgs1, Vgs2 supplied from the data driver 224 in accordance with the mode selection signal MD since the operation points Q1, Q2 of the driving thin film transistor T2 exist in the non-saturation region. As a result, the EL display device and the driving method thereof according to the third embodiment of the present invention might prevent picture quality deterioration by compensating the deviation of the threshold voltage Vth of the driving thin film transistor T2.

In the EL display device and the driving method thereof according to the third embodiment of the present invention, as shown in FIG. 8, in case that the digital data supplied from the outside is 4 bit and 12 gray levels are expressed in one EL cell OLED by use of the 4 bit digital data, an example is described as follows.

The data driver 224 sequentially supplies the modulation data signal (8) of first step having the duty cycle corresponding to the fact that the digital data value is 8 and the modulation data signal (4) of second step having the duty cycle corresponding to the fact that the digital value is 4, subsequent to the first step to the first switching device SW1 while the scan pulse SP is supplied to the gate line GL. Accordingly, the first switching device SW1 sequentially supplies the on/off signal Vdata of low state having any one level of the first and second levels according to the mode selection signal MD to the gate terminal of the driving thin film transistor T2 through the switching thin film transistor T1, in response to each of the modulation data signals (8, 4) of the first and second steps sequentially supplied from the data driver 224, and at the same time the pulse width modulation signal Vs of first and second steps being synchronized with each of the modulation data signals (8, 4) of the first and second steps from the pulse supplier 140 and having the same duty cycle are supplied step by step to the cathode electrode of the EL cell OLED.

Because of this, the driving thin film transistor T2 is turned on by the on/off signal Vdata of low state, having any one level of the first and second levels, sequentially supplied by the first and second steps, to control the size of the current amount Id supplied from the first supply voltage source VDD1 through the EL cell OLED. At this moment, the EL cell OLED emits light for the duty cycle of each of the pulse width modulation signals Vs of the first and second steps supplied to the cathode electrode of itself.

Accordingly, the EL display device and the driving method thereof according to the third embodiment of the present invention has the EL cell OLED emit light by the first and second steps while the scan pulse SP is supplied to the gate line GL, thus 12 gray levels are expressed by the sum of 8 gray levels by the light-emitting time of the first step and 4 gray levels by the light-emitting time of the second step. At this moment, the 12 gray levels expressed by the EL display panel and the driving method thereof according to the third embodiment of the present invention are expressed as the bright 12 gray levels or the dark 12 gray levels in accordance with the mode selection signal MD.

As described above, the electro-luminescence display device and the driving method thereof according the present invention supplies the on/off signal of high or low state to the driving thin film transistor of the pixel cell to drive, and at the same time supplies the pulse amplitude modulation signal to the cathode electrode of the EL cell to control the light-emission brightness of the EL cell by steps so that the desired gray level is expressed by the sum of the light-emitting brightness by steps, thus the voltage between the drain and source terminals is made to be small in relation to the voltage between the gate and source of the fixed driving thin film transistor to make the driving thin film transistor operate at the non-saturation region. Accordingly, the present invention reduces the deviation of the threshold voltage generated between the driving thin film transistors due to the non-uniformity of the excimer laser illuminated upon the formation of the driving thin film transistor, thereby preventing the picture quality deterioration by the deviation of the threshold voltage.

Further, the electro-luminescence display device and the driving method thereof according to the embodiment of the present invention controls the size of the current flowing in the EL cell in accordance with the mode selection signal, and at the same time, supplies the pulse width modulation signal to the cathode electrode of the EL cell to express the gray level by the sum of the light-emitting time of the EL cell and the light-emitting time by the control, thereby operating the driving thin film transistor at the non-saturation region by making the voltage between the drain and source terminals small in relation to the voltage between the gate-source terminals of the fixed driving thin film transistor. Accordingly, the present invention reduces the deviation of the threshold voltage generated between the driving thin film transistors caused by the non-uniformity of the excimer laser illuminated when forming the driving thin film transistors, thus the picture quality deviation caused by the deviation of the threshold voltage might be prevented and the entire brightness of the electro-luminescence panel might be able to be controlled in two modes in accordance with the mode selection signal.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electro-luminescence display device, comprising:

an electro-luminescence cell connected between a first supply voltage source and a ground voltage source to emit light by a current supplied from the first supply voltage source;

a cell driver formed every intersection of gate lines and data lines and comprising a driving thin film transistor connected between the first supply voltage source and the electro-luminescence cell to control a current flowing in the pixel cell; and a pulse supplier to supply to the electro-luminescence cell a pulse amplitude modulation signal which is divided to have N (N is a natural number) numbers of different voltage levels from each other and connected between a cathode of the electro-luminescence cell and the ground voltage source, wherein the driving thin film transistor operates at the non-saturation region, wherein each of the N numbers of pulse amplitude modulation signals has a read section of a first voltage level and a write section having different voltage levels between the voltage level of the read section and a ground voltage from the ground voltage source.

2. The electro-luminescence display device according to claim 1, further comprising:

a data driver to supply to the data line an on/off signal which is to drive the driving thin film transistor; and a gate driver to supply a scan pulse to the gate line.

3. The electro-luminescence display device according to claim 2, wherein the cell driver includes:

a switching thin film transistor connected to the gate line, the data line and the driving thin film transistor, to supply the on/off signal on the data line to the gate terminal of the driving thin film transistor; and a storage capacitor connected between the gate terminal of the driving thin film transistor and the first supply voltage source.

4. The electro-luminescence display device according to claim 2, wherein the data driver includes:

a first resistor and a second resistor connected in series between a second supply voltage source and the pound voltage source; and a first switching device connected between the second resistor and the ground voltage source.

5. The electro-luminescence display device according to claim 4, wherein the data diver supplies to the data line a voltage on a node between a first resistor and a second resistor in accordance with the switching of the first switching device and the on/off signal of high state or low state by a voltage difference from the first supply voltage source.

6. The electro-luminescence display device according to claim 4, wherein N numbers of pulse signals corresponding to the bit number and having the same duty cycle are supplied to the gate terminal of the first switching device while a scan pulse is supplied to the gate line.

7. The electro-luminescence display device according to claim 6, wherein the pulse supplier supplies to a cathode terminal of the electro-luminescence cell the pulse amplitude modulation signal which is synchronized with the N numbers of pulse signals, has the same duty cycle and has N numbers of different voltage levels from each other.

8. The electro-luminescence display device according to claim 1, wherein the first voltage level is the same as the voltage level from the first supply voltage source.

9. The electro-luminescence display device according to claim 1, wherein the driving thin film transistor operates at the non-saturation region by a voltage difference between the drain-source caused by a voltage supplied to the write section of the N numbers of pulse amplitude modulation signals in relation to a voltage between fixed gate and source terminals.

10. The electro-luminescence display device according to claim 8, wherein the electro-luminescence cell emits light by a voltage level of the write section of each of the N numbers of pulse amplitude modulation signal and the current corresponding to a voltage difference with the first supply voltage source, and expresses a gray level corresponding to the N bit by the sum of the N numbers of the light-emitting brightness.

11. A driving method of an electro-luminescence display device having a cell driver inclusive of an electro-luminescence cell which is connected between a first supply voltage source and a ground voltage source to emit light by a current supplied from the first supply voltage source and a driving thin film, transistor which is formed at each intersection of gate lines and data lines and connected between the first supply voltage source and the electro-luminescence cell to control a current flowing in the pixel cell and a pulse supplier connected between a cathode of the electro-luminescence cell and the ground voltage source, comprising the steps of:

supplying to the electro-luminescence cell a pulse amplitude modulation signal which is divided to have n (n is a natural number) numbers of different voltage levels from one another; and operating the driving thin film transistor at a non-saturation region by the pulse amplitude modulation signal, wherein each of the n numbers of pulse amplitude modulation signals has a read section of a first voltage level and a write section having different voltage levels between the voltage level of the read section and a around voltage from the ground voltage source.

12. The driving method according to claim 11, further comprising the steps of:

generating an on/off signal to drive the driving thin film transistor; and supplying a scan pulse to the gate line.

13. The driving method according to claim 12, wherein the step of generating the on/off signal includes:

generating n numbers of pulse signals that correspond to the bit number of a digital data and have the same duty cycle while a scan pulse is supplied to the gate line; and generating the on/off signal of high state and low state by use of the pulse signal.

14. The driving method according to claim 11, wherein the pulse amplitude modulation signal is supplied to a cathode terminal of the electro-luminescence cell, is synchronized with the pulse signal, has the same duty cycle and has the n numbers of different voltage levels from each other.

15. The driving method according to claim 11, wherein the first voltage level is the same as the voltage level from the first supply voltage source.

16. The driving method according to claim 11, wherein the driving thin film transistor operates at the non-saturation region by a voltage difference between the drain and the source by the voltage supplied to the write section of the n numbers of pulse amplitude modulation signal in relation to a voltage between the gate and the source which are fixed.

17. The driving method according to claim 11, wherein the electro-luminescence cell emits light by the currrent corresponding to a voltage difference between the first supply voltage source and a voltage level of the write section of each of the n numbers of pulse amplitude modulation signals, and expresses a gray level corresponding to the n bit by the sum of the light-emitting brightness of each of the n numbers.

18. An electro-luminescence display device, comprising:

an electro-luminescence cell connected between a first supply voltage source and a ground voltage source to emit light by a current supplied from the first supply voltage source;

a cell driver formed at each intersection of gate lines and data lines and comprising a driving thin film transistor connected between the first supply voltage source and the electro-luminescence cell to control a current flowing in the pixel cell; and a pulse supplier to supply a pulse width modulation signal to the electro-luminescence cell and connected between a cathode of the electro-luminescence cell and the ground voltage source, wherein the driving thin film transistor operates at a non-saturation region, wherein the pulse width modulation signal of each of the n steps has the same read section of a first voltage level and a write section having a level between a around voltage from the ground voltage source and a voltage level of the read section.

19. The electro-luminescence display device according to claim 18, further comprising:

a data driver to supply to the data line an on/off signal which is for driving the driving thin film transistor; and a gate driver to supply a scan pulse to the gate line.

20. The electro-luminescence display device according to claim 19, wherein the cell driver includes:

a switching thin film transistor connected to the gate line and the data line and the driving thin film transistor to supply an on/off signal on the data line to a gate terminal of the driving thin film transistor in response to the scan pulse; and a storage capacitor connected between a gate terminal of the driving thin film transistor and the first supply voltage source.

21. The electro-luminescence display device according to claim 19, wherein the data driver includes:

a first resistor and a second resistor connected in series between a second supply voltage source and the ground voltage source;

a first switching device connected between the second resistor and the ground voltage source.

22. The electro-luminescence display device according to claim 21, wherein the data driver supplies to the data line the on/off signal of high state or low state by a voltage difference between the first supply voltage source and a voltage on a node between a first resistor and a second resistor in accordance with the switching of the first switching device.

23. The electro-luminescence display device according to claim 18, wherein the pulse width amplitude modulation signal having a duty cycle corresponding to the bit number of a digital data and being divided into n steps (n is a natural number) is supplied to a gate terminal of the first switching device while a scan pulse is supplied to the gate line.

24. The electro-luminescence display device according to claim 18, wherein the pulse supplier supplies to the cathode terminal of the electro-luminescence cell the pulse width modulation signal which is synchronized with the modulation data signal, has the same duty cycle and is divided into the n steps.

25. The electro-luminescence display device according to claim 18, wherein the first voltage level is the same as the voltage level from the first supply voltage source.

26. The electro-luminescence display device according to claim 18, wherein the driving thin film transistor operates at the non-saturation region by a voltage difference between a drain and a source caused by a voltage supplied in the write section of a pulse width modulation signal of each of the n steps in relation to a voltage of a gate and a source which are fixed.

27. The electro-luminescence display device according to claim 24, wherein the electro-luminescence cell emits light by the current caused by a voltage difference between the first supply voltage source and a voltage level of the write section of each of the n steps of pulse width modulation signals, and expresses a gray level corresponding to the n bit by the sum of a light-emitting time of each of the n step.

28. The electro-luminescence display device according to claim 21, wherein the data driver further includes:

a third resistor connected between the second supply voltage source and a node between the first and the second resistors; and a second switching device connected between the third resistor and the second supply voltage source and connects the third resistor in parallel to the first resistor in response to a mode selection signal supplied from the outside.

29. The electro-luminescence display device according to claim 28, wherein the data driver supplies to the data line the on/off signal of low state having a first level or high state by a voltage difference between the first supply voltage source and a voltage on a node between a first resistor and a second resistor in accordance with the switching of the first switching device in case the second switching device is turned off by the mode selection signal, and supplies to the data line the on/off signal of low state having a second level or high state by a voltage difference between the first supply voltage source and a voltage on a node between the second resistor and a parallel resistor of the first and second resistors in accordance with the switching of the first switching device in case the second switching device is turned on by the mode selection signal.

30. The electro-luminescence display device according to claim 29, wherein the driving thin film transistor has first and second voltages between gate and source which are different in accordance with the on/off signal of low state having the first and second levels.

31. The electro-luminescence display device according to claim 30, wherein the driving thin film transistor controls the size of a current flowing in the electro-luminescence cell in 2 levels in accordance with the first and second voltages between gate and source.

32. A driving method of an electro-luminescence display device having a cell driver inclusive of an electro-luminescence cell which is connected between a first supply voltage source and a ground voltage source and emit light by a current supplied from the first supply voltage Source and a driving thin film transistor which is formed at each intersection of gate lines and data lines and connected between the first supply voltage source and the electro-luminescence cell to control a current flowing in the pixel cell and a pulse supplier connected between a cathode of the electro-luminescence cell and the ground voltage source, comprising the step of:

operating the driving thin film transistor at a non-saturation region, wherein a pulse width amplitude modulation signal has a read section of a first voltage level and a write section having different voltage levels between the voltage level of the read section and a around voltage from the ground voltage source.

33. The driving method according to claim 32, further comprising the steps of:

generating an on/off signal to drive the driving thin film transistor;

supplying a scan pulse to the gate line; and supplying the pulse width modulation signal to the electro-luminescence cell.

34. The driving method according to claim 33, wherein the step of generating the on/off signal includes:

generating a modulation data signal which has a duty cycle corresponding to the bit number of a digital data and is divided into n steps (n is it natural number) while a scan pulse is supplied to the gate line; and generating the on/off signal of high state and low state by use of the modulation data signal.

35. The driving method according to claim 34, wherein the pulse width modulation signal is synchronized with the modulation data signal, has the same duty cycle, is divided into the n steps, and is supplied to a cathode terminal of the electro-luminescence cell.

36. The driving method according to claim 32, wherein the first voltage level is the same as the voltage level from the first supply voltage source.

37. The driving method according to claim 34, wherein the driving thin film transistor operates at the non-saturation region by a voltage difference between the drain and the source by the voltage supplied to the write section of each of the pulse width modulation signal of n step in relation to a voltage between the gate and the source which are fixed.

38. The driving method according to claim 34, wherein the electro-luminescence cell emits light by the current caused by the voltage difference between the first supply voltage source and a voltage level of the write section of each of the pulse width modulation signals of n step, and expresses a gray level corresponding to the n bit by the sum of the light-emitting time of each of the n steps.

39. The driving method according. to claim 33, wherein the step of generating the on/off signal includes:

generating the on/off signal of low state having a first level or high state by a mode selection signal; and generating the on/off signal of low state having a second level of high state by the mode selection signal.

40. The driving method according to claim 39, wherein the driving thin film transistor has first and second voltages between gate and source which are different from each other, in accordance with the on/off signal of low state having the first and second levels.

41. The driving method according to claim 40, wherein the driving thin film transistor controls the size of a current flowing in the electro-luminescence cell in 2 levels in accordance with the first and second voltages between gate and source.

* * * * *